US007377846B2

(12) United States Patent
Umeda

(10) Patent No.: US 7,377,846 B2
(45) Date of Patent: May 27, 2008

(54) COIN RECEIVING AND DISBURSING APPARATUS WITH STORAGE DEVICES CAPABLE OF PROPELLING COINS

(75) Inventor: Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 87 days.

(21) Appl. No.: 11/321,410

(22) Filed: Dec. 29, 2005

(65) Prior Publication Data

US 2006/0183418 A1 Aug. 17, 2006

(30) Foreign Application Priority Data

Jan. 5, 2005 (JP) ..... 2005-000330

(51) Int. Cl.
*G07D 3/00* (2006.01)

(52) U.S. Cl. ..... 453/3

(58) Field of Classification Search ..... 453/3–7, 453/9, 11, 56, 63; 194/350, 353
See application file for complete search history.

(56) References Cited

U.S. PATENT DOCUMENTS 1,714,904 A * 5/1929 Davies ..... 446/11
4,635,661 A * 1/1987 Uematsu et al. ..... 194/217
5,551,912 A * 9/1996 Takemoto et al. ..... 453/56
5,695,395 A * 12/1997 Ota et al. ..... 453/57
5,899,804 A * 5/1999 Chiba et al. ..... 453/11
6,039,643 A * 3/2000 Kurosawa et al. ..... 453/3
RE37,662 E 4/2002 Uchida et al.
6,726,056 B2 * 4/2004 Yuyama et al. ..... 221/124
2003/0201146 A1 10/2003 Abe et al.

FOREIGN PATENT DOCUMENTS

JP 06-274740 9/1994
JP 09-161123 6/1997

* cited by examiner

*Primary Examiner*—Patrick Mackey
*Assistant Examiner*—Mark Beauchaine

(57) ABSTRACT

A coin receiving and disbursing apparatus aligns coins to travel along a curved path. The coins can be verified and appropriately sorted by denomination and dropped into a plurality of hopper units arranged in two arrays below the coin path. Positioned between the two arrays of hoppers is a conveying belt. The hoppers are operatively positioned to propel coins upon receipt of a discharge signal upward into the air fall on the coin conveying device. The arrangement of the hoppers and the coin conveying device minimizes bouncing of the coins and facilitates their travel to a money discharge port.

8 Claims, 17 Drawing Sheets

(A)

(B)

(A)

(B)

COIN RECEIVING AND DISBURSING APPARATUS WITH STORAGE DEVICES CAPABLE OF PROPELLING COINS

BACKGROUND OF THE INVENTION

1. Field of the Invention

The present invention relates to a coin receiving and disbursing apparatus which stores a plural of denominations of coins in a separate reserving part for each coin denomination, and dispenses a specified number of a specified denomination of coins in response to an instruction from a related instrument, more specifically the present invention also relates to a compact coin receiving and disbursing apparatus, in particular, a low-height coin receiving and disbursing apparatus suited for installation under or beside a POS register and capable of completing the disbursement of coins in a short time period.

2. Description of Related Art

The term "coin" used herein means coins of currency, tokens and medals, which may be circular or polygonal in shape. In one conventionally known coin receiving and disbursing apparatus, after separating coins by a rotary disc, the coins travel in line along a received money conveying path and are checked by a judging unit to determine whether the coin is fake or real and to determine the coin denomination. The coins are then sorted by denomination in a sorting path after sequentially passed through a reject gate and overflow gate. The sorted coins are aligned on each side of a money disbursing path after passing through a chute, and introduced into a respective hopper provided for each denomination. The coins in each hopper engage a selector disk with a projection disposed on an inner periphery of an oblique circular disc, and a specified number of coins are disbursed from a hopper of a specified coin denomination into a money disbursing path in response to an instruction for money disbursement (see, Japanese Patent No. 2945235).

In the above conventional art, a coin is released from a hopper to a money disbursing path. In other words, the oblique circular disc is arranged so that it is in the lowest level on the side of the money disbursing path, and its level rises as the distance from the money disbursing path increases. Therefore, the money disbursing path is not able to convey a coin from a hopper unless it is disposed at a lower level than the lowermost end of the oblique circular disc. Since the received money conveying path, the hopper and the disbursing money conveying path are arranged in a stacked array, reduction of the height of the money receiving and disbursing apparatus is limited. In addition, since a coin may be disbursed with some speed towards the disbursing money conveying path from the hopper, the coin may strike the disbursing money conveying path and bounce in various directions, creating a problem that the money disbursement is not completed in a desired short time period.

SUMMARY OF THE INVENTION

The first object of the present invention is to provide a compact coin receiving and disbursing apparatus.

The second object of the present invention is to provide a small-sized, particularly, low-height coin receiving and disbursing apparatus.

The third object of the present invention is to provide a small-sized coin receiving and disbursing apparatus capable of completing money disbursement in a short time.

In order to achieve the above objects, a coin receiving and disbursing apparatus can be configured as follows.

A coin receiving and disbursing apparatus includes an alignment device that aligns coins inserted through a coin receiving port in line and a received money conveying path for coins aligned in line by the alignment device. A received money conveying device makes the aligned coins travel the received money conveying path to a sorting unit for sorting the coins conveyed by the conveyance device by denomination. A plurality of hoppers are arranged in two arrays for receiving the coins sorted by the sorting unit by denomination in a bulk condition. A disbursing money conveying device is disposed parallel with and between the two arrays of hoppers to receive coins from the hoppers.

In this configuration, a coin inserted through a money receiving port is aligned in line by the alignment device, and conveyed along the sorting path by the received money conveying device. The coins traveling the sorting path are sorted by specific denominations in specific sorting units to drop into a hopper provided below by denomination and stored therein. In response to an instruction for disbursement, a hopper for a specific denomination is actuated, and specified number of stored coins are released. Coins are projected upward by a spring propelled lever toward the disbursing money conveying device which is disposed in parallel with the hopper. Therefore, the hopper and the disbursing money conveying device are disposed in parallel with each other rather than in a stacked arrangement, so that the coin receiving and disbursing apparatus can be miniaturized. Further, when a coin is flicked out upward, the momentum of the coin is attenuated by the gravity with a trajectory that raises above a common disbursing coin conveying device, so that the coin will not be as energetic in any collision with the disbursing money conveying device. In other words, when a coin comes into collision with the disbursing money conveyance device and bounce in various directions, the amount of bouncing is small, and ceases in a short period of time, so that the conveyance to the money discharging port is quickly completed.

The hopper can have a through hole that allows coins to drop one by one, and includes a rotatable rotary disc that is inclined so that its lower end is laterally farther from the disbursing money conveying device than its upper end.

In this configuration, coins are flicked out while dropping one by one into the through hole of the rotary disc. In the rotary disc, the lower end is laterally farther from the disbursing money conveying device than the upper end. In other words, since the upper end of the rotary disc is inclined toward the disbursing money conveying device, a coin flicked out from a hopper is flicked out upwardly toward the disbursing money conveying device. Further, since momentum of the coin is attenuated, the coin will not energetically come into collision with the disbursing money conveying device, and hence any dancing of coins on the disbursing money conveying device quiets down in a short time, so that disbursement is completed in a short time period.

The coin conveyance part of the disbursing money conveying device is disposed between the upper end and the lower end of the inclining rotary disc. In other words, the rotary disc is disposed in parallel with the coin conveyance part. Since the conveyance device is provided in a minimum required height for the rotary disc at the level of the hopper, it is possible to reduce the height of the apparatus.

A part of the coin conveying device in an up-and-down direction. In other words, the hopper and the coin conveying device laterally align and partly overlap with each other in the lateral direction and the width of the coin receiving and disbursing apparatus can be made smaller by that overlapping part.

The money discharging port are arranged substantially parallel with each other and by forming the received money conveying path in a channel form, coins aligned by the alignment device, after passing through the money receiving port, travel a path from the money receiving port, through a U-turn and then travel in a path approaching the money discharging port. A specific sorting unit is provided in the leaving path and the approaching path. The plurality of hoppers are arranged in parallel below the sorting units with the disbursing money conveying device disposed between the hopper arrays, between the alignment device and the sorting part of the leaving path. A denomination judging device and a reject coin sorting device are arranged, in this order, from the side of the alignment device. The reject coin sorting device can return a fake coin to the disbursing money conveying device. Therefore, a cash box for fake coins is no longer required, and accordingly it is possible to provide a compact apparatus.

Since the conveyance belt has a slope declining toward the money discharging port, even when a coin hits the conveyance belt and bounces, it bounces toward the money discharging port, so that it is possible for the coin to stabilize in a short period of time.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 12 are a perspective view, a plan view, a front view and a bottom view of a position adjustment unit of a curve part guiding device of a coin receiving and disbursing apparatus embodying the present invention wherein FIG. 12A is a perspective view, FIG. 12B is a plan view, FIG. 12C is a front view and FIG. 12D is a bottom view.

FIG. 14 show a coin hopper of a coin receiving and disbursing apparatus embodying the present invention, wherein FIG. 14A is a perspective view, FIG. 14B is a plan view, FIG. 14C is a left lateral view, FIG. 14D is a G-G section view, FIG. 14E is a front view in the condition that a reserving bowl is removed, and FIG. 14F is an H-H section view.

FIG. 16 are section views showing a coin receiving and disbursing apparatus embodying the present invention, wherein FIG. 16A is a section view viewed from the side of the money discharging port and FIG. 16B is a section view viewed from the side of the U-turn path.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
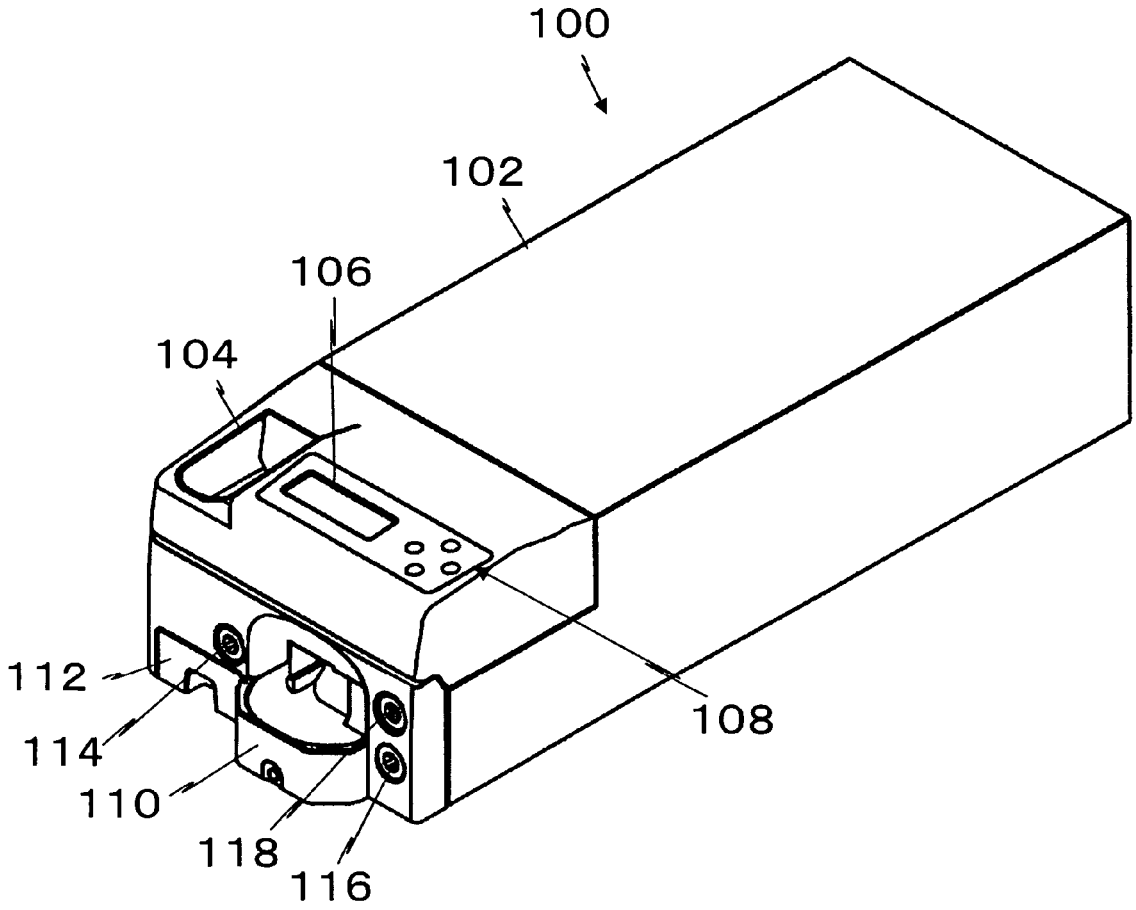
FIG. 1 is a perspective view of a coin receiving and disbursing apparatus embodying the present invention.

The present embodiment is a coin receiving and disbursing apparatus which can receive eight denominations of coins, i.e., 2-euro, 1-euro, 50-cent, 20-cent, 10-cent, 5-cent, 2-cent and 1-cent coins which are currency of the European Union, and stores the coins by denomination, and further can disburse a specified number of a specified denomination of coins in accordance with an instruction of disbursement. In FIG. 1, a coin receiving and disbursing apparatus 100 has a coin receiving port 104 on an upper face on the front side of a body cover 102 of a vertically long box shape.

The coin receiving port 104 is a vertically long D-shaped slot when viewed two-dimensionally, and has a width slightly larger than the diameter of the largest coin, and a length of about three times the largest coin. Beside the coin receiving port 104, a display 106 for displaying settings and alarm information, and an operational user button 108 are discussed. The operational button 108 permits the settings to be changed by an operation thereof while checking the setting information displayed in the display 106.

A bowl-like money discharging port 110 is provided in a lower part of the front face of the coin receiving and disbursing apparatus 100. Therefore, the money receiving port 104 and the money discharging port 110 are disposed almost in parallel. A full coin cash box 112 is disposed on the left side of the money discharging port 100. The cash box 112 may be removed by unlocking a lock key 114 provided on the front face and then manually pulled out. On the right side of the money discharging port 119, a power key 116 is provided.

The power key 116, when in an ON state can be put in an OFF state when it is turned in a predetermined direction and the power key 116 in an OFF state comes into an ON state when it is turned in an opposite direction. Above the power key 116, a setting key 118 is provided. The setting key 118 enables a switching of a mode of the coin receiving and disbursing apparatus 100 by a position selected by a turning operation.

Specifically, the setting key 118 sets the coin receiving and disbursing apparatus 100 at a normal money receiving mode at a predetermined position, and sets it at a maintenance mode at another predetermined position. In the maintenance mode, by conducting a certain operation through operation of the operational button 108, it is possible to withdraw all the reserved coins, for example.

Next, devices placed inside the body cover 102 will be explained with reference to FIGS. 2 and 3. Inside the body cover 102, a box-like slide frame 122 is disposed so as to be removable via a slide rail (not shown). In the slide frame 122, devices are disposed in generally an upper half part and a lower half part. To be more specific, in the upper half part, a received money conveying device 124 is disposed, and in a lower half part, a coin storing device 126 and a disbursing money conveying device 128 are disposed. The received money conveying device 124 conveys a coin sent from an alignment device 130 at a certain speed along the received money conveying path 132.

Figure 5:
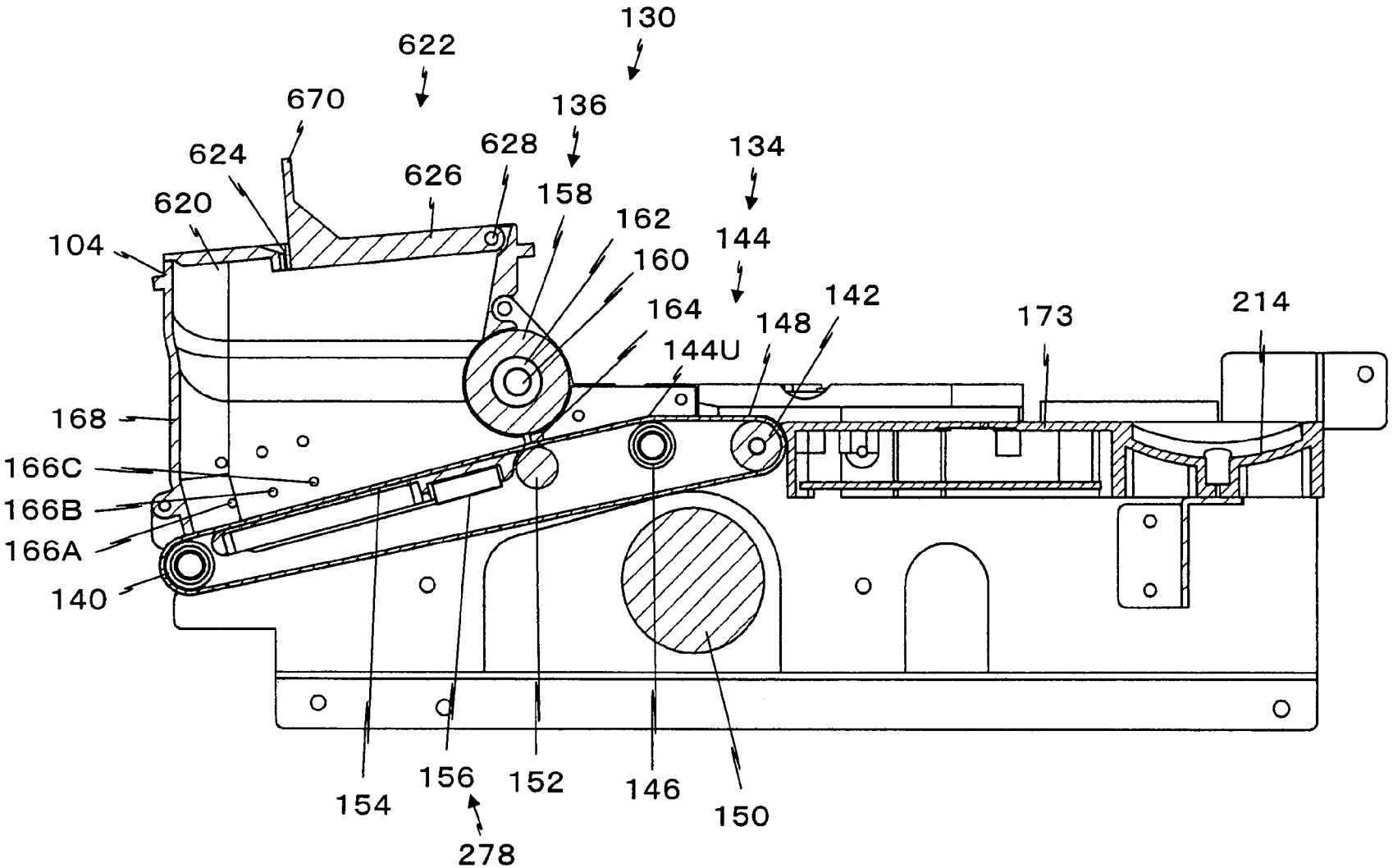
FIG. 5 is a cross section view of a money receiving port and an alignment device of a coin receiving and disbursing apparatus embodying the present invention.

The alignment device 130 aligns a plurality of denominations of coins received in bulk from the money receiving port 104 into a line of coins. Accordingly, another device having a similar function may be used as well. As shown in FIG. 5, in the present embodiment, the alignment device 130 is composed of a band conveyer 134 and breaking means 136 directly below the money receiving port 104.

The band conveyer 134 is a conveyance belt 144 which is slightly wider than the coin having the largest diameter, and wound around a first roller 140 and a second roller 142 disposed parallel at a certain interval so that it forms an ascending slope with respect to a traveling direction of coins. The conveyance belt 144 receives a certain tension by a tension roller 146 disposed under an upper belt 144U. Between the tension roller 146 and the second roller 142, an upper belt relay part 148 is disposed substantially horizontally.

The upper belt 144U between the first roller 140 and the tension roller 146 is inclined upward with respect to the traveling direction of coins. The second roller 142 is rotated in a clockwise direction in FIG. 5 by a driving motor 150, and the upper belt 144U moves from a left below to a right above in FIG. 5. A stationary guide axis 152 is provided on an upstream side of the traveling direction of coins so as to transverse below the upper belt 144U. Preferably, the guide axis 152 is covered with a sleeve (not shown), and is in rolling contact with the conveyance belt 144.

On an upstream side of the guide axis 152, a plate-like guide plate 154 is disposed and a slot-in sensor 156 for detecting a coin is attached. As the band conveyer 134, a belt which is covered with rubber having a large coefficient of friction with a coin, at least on its surface is preferred.

Next, the breaking means 136 will be explained. The breaking means 136 breaks any pile up of coins and aligns them one by one on the conveyance belt 144. In the present embodiment, the breaking means 136 is implemented by a breaking roller 158. The breaking roller 158 is placed directly above the belt 144 and is attached via a one-way clutch 162 to an axis 160 that is rotatably mounted in an opening on the lateral wall of the money receiving port 104.

The axis 160 is drivingly connected with the driving motor 150, and rotates in the same direction as the second roller 142. In other words, the axis 160 is rotated in the clockwise direction in FIG. 5 at a predetermined speed ratio with respect to the upper belt 144U. In other words, the breaking roller 158 is rotated at a predetermined speed in the clockwise direction in FIG. 5.

Therefore, the peripheral surface contacting with the upper belt 144U of the breaking roller 158 moves in a direction opposite to the traveling direction of the upper belt 144U. When the second roller 142 rotates in a direction opposite to the direction in which a coin is received, the axis 160 rotates in the same direction, however, the breaking roller 158 is not rotated because the rotating power is blocked by a one-way clutch 162.

Between the bottom side of the periphery of the breaking roller 158 and the upper belt 144U, a coin passage gap 164 is formed which is slightly larger than the thickness of the thickest coin. The upper belt 144U is inhibited from moving downward, or moving in the direction leaving from the breaking roller 158 by the stationary guide axis 152. Consequently, in the case where thicknesses of coins other than the thickest coin are equal to or more than one half of the thickness of the thickest coin as is the case of euro coins, only one coin whose one face contacts the upper belt 144U is allowed to pass through the coin passage gap 164.

When two or more coins are piled up on the upper belt 144U, the upper coin(s) is(are) repelled by rotation of the breaking roller 158 and removed from the lower coin. This action is continuously carried out, and only one coin passes through the coin passage gap 164 together with the belt 144. Consequently, a coin having passed through the coin passage gap 164 is aligned on the conveyance belt 144.

Near the upper belt 144U of the money receiving port 104 and the first roller 140, standing coin detection sensors 166A, 166B and 166C are provided. The standing coin detection sensors 166A, 166B and 166C are disposed above a part which is in the lowest level of the inclining belt 144.

In the present embodiment, the standing coin detection sensors 166A, 166B and 166C are transmissive photoelectronic sensors and are provided in such a manner that a light projecting part is disposed on one side of the wall surface of the belt 144 and light receiving parts are disposed on the opposite side of the wall surface across the belt 106 and near the upper belt 144 in three different positions along the traveling direction of the belt 144.

Since the position of any coin rolling is unstable, the standing coin detection sensors are provided in plural so as to securely detect any standing coin. However, if detection can be secured with only one sensor, the standing coin detection sensor may be only one. When a coin is inserted through the money receiving port 104, the coin is detected by the slot-in sensor 156 which is usually disposed under the upper belt 144U, and the driving motor 150 is rotated.

As a result, the upper belt 144U moves toward a denomination judging device 125 as will be described below, and the lower side of the periphery of the breaking roller 158 moves in an opposite direction. Accordingly, the coins pass one by one through the gap 164 as described above, and the coins are aligned in line on the upper belt 144 at least in the relay part 148.

When the coin leans against a lateral wall of the money receiving port 104, it rolls down on the belt 144 because the upper belt 144U inclines, or stops at a predetermined position after rolling with the movement of the belt 144. In this case, detection is carried out by either of the three standing coin detection sensors 166A, 166B and 166C.

When the slot-in sensor 156 does not detect a coin and either of the standing coin detection sensors 166A, 166B and 166C detects a coin, the driving motor 150 is forwardly rotated following a short-time reverse rotation. This reverse rotation allows the upper belt 144U to move in a reverse direction of the conveyance direction of coins.

In other words, in the left-hand movement of FIG. 5, even when the axis 160 is rotated in the counterclockwise direction, the breaking roller 158 is hindered from rotating by the one-way clutch 162 and kept in a stationary state. A standing coin travels with the upper belt 144U, guided by an arcuate wall 168 at an edge of the money receiving port 104, and the face of the coin is brought into a perpendicular alignment to the traveling direction of the upper belt 144U Then the upper belt 144U travels in the coin conveyance direction and the standing coin is moved together with the upper belt 144U at its lower end, and forced to fall on the upper belt 144U and passes through the gap 164.

Next, the received money conveying path 132 will be explained with reference to FIG. 3. The received money conveying path 132 is composed of a judging and rejecting path 170 and a sorting path 172. First, explanation will be made on the judging and rejecting path 170. The judging and rejecting path 170 is disposed subsequently downstream of the alignment device 130, and extends in a traveling direction of the band conveyer 134 so as to be substantially flush with the relay part 148 of the band conveyer 134 and placed on the upper face of a plate-like slide base 173.

On an upper face of one side of the slide base 173, a first guide rail 174 is formed. The first guide rail 174 is formed with a deviation guide part 176 inclining toward the center and the conveyance direction of coins D from one side of the band conveyer 134, and a judgment guide part 178 and a rejection guide part 180 continuing therefrom.

The judgment guide part 178 and the rejection guide part 180 are linearly formed in series, and slope at a small angle from the traveling direction of coins D. The coin moving in such a manner, as being dragged by the received money conveying device 124, is guided while a periphery thereof is constantly being held in close contact with the guide parts due to the inclination as described above. Therefore, the judging and rejecting path 170 is a linear path formed along the deviation guide part 176, the judgment guide part 178 and the rejection guide part 180.

Next, the denomination judging device 125 will be explained with reference to FIG. 6. The denomination judging device 125 is disposed so as to face the judgment guide part 178. The denomination judging device 125 determines whether a coin guided by the judgment guide part 178 is real or fake and further determines the denomination thereof.

In the present embodiment, real/fake and denomination are determined by detecting a diameter, a material and a thickness of a coin by a plurality of coils and comparing the detection results with reference values. A plate-like sensor attachment 182 is disposed parallel with the slide base 173 at a distance slightly larger than the thickness of the thickest coin above the slide base 173.

To the sensor attachment 182 are fixed a first upper sensor 188U implementing a first diameter sensor 186 in which a coil (not shown) is wound on a first core 184U having a rectangular end face; a third upper sensor 194U implementing a third diameter sensor 190 in which a coil is wound on a third core 192U having a rectangular end face; and a second upper sensor 200U implementing a third diameter sensor 196 having a second core 198U having a circular end face.

Opposite to the first core 184U, the second core 198U and the third core 192U, a first core 184L of a first lower sensor 188L, a second core (not shown) of a second lower sensor 200L and a third core 192L of a third lower sensor 194L are disposed on the bottom face of the slide base 173. The second sensors 200U and 200L have good efficiency in monitoring magnetic flux because almost the whole periphery of the coil is surrounded by a circular partition.

As to the first sensors 188U and 188L and the third sensors 194U and 194L, since the coils are surrounded only by lateral side walls, the generation efficiency of magnetic flux is reduced. However, this is advantageous in that neighboring sensors may be closely arranged due to an absence of partitions. Therefore, the slide base 173 and the sensor attachment 182 are made of a non-magnetic material, specifically, a resin so as not to attenuate the magnetic flux.

The first diameter sensor 186 is constituted by differentially connecting the coils of the first upper sensor 188U and the first lower sensor 188L. The second diameter sensor 196 is constituted by cumulatively connecting the coils of the second upper sensor 200U and the second lower sensor 200L. The third diameter sensor 190 is constituted by cumulatively connecting the coils of the third upper sensor 194U and the third lower sensor 194L.

The first diameter sensor 186 and the third diameter sensor 190 are disposed on a straight line X which is perpendicular to the judgment guide part 178, at a predetermined distance from the judgment guide part 178. More specifically, the first diameter sensor 186 is disposed in such a manner that when a one-cent coin having the smallest diameter moves while guided by the judgment guide part 178 (see the circle S shown by dotted line), the end portion faces about one third of the first cores 184L and 184R.

The second diameter sensor 196 is disposed on the downstream of the coin traveling direction such that ends which are closer to the judgment guide part 178, of the core 198U of the second upper sensor 200U and the core (not shown) of the second lower sensor 200L slightly overlap with the cores 184U and 184L of the first diameter sensor 186, and the ends which are far from the judgment guide part 178 slightly overlap with the cores 192U and 192L of the third diameter sensor 190.

The third diameter sensor 190 is disposed in such a manner that when a two-euro coin having the largest diameter moves under guidance (see the circle L shown by dotted line), the end portion faces about one third of the third cores 192U and 192L.

By determining a diameter by means of these three sensors, the area of each core may be reduced since the core opposite to a coin is divided, and hence the sensitivity is improved. In other words, the accuracy of diameter determination improves and an advantage of low cost is also obtained by the coil-based sensor.

The denomination judging device 125 may discriminate real/fake and determine the denomination by a device having a similar functionality, for example, by image recognition of a pattern on the surface of the coin followed by comparison with a reference image. The first diameter sensor 186 serves also as a thickness sensor because almost the entire face of the cores 184U and 184L thereof faces with a coin other than a one-cent coin.

Figure 6:
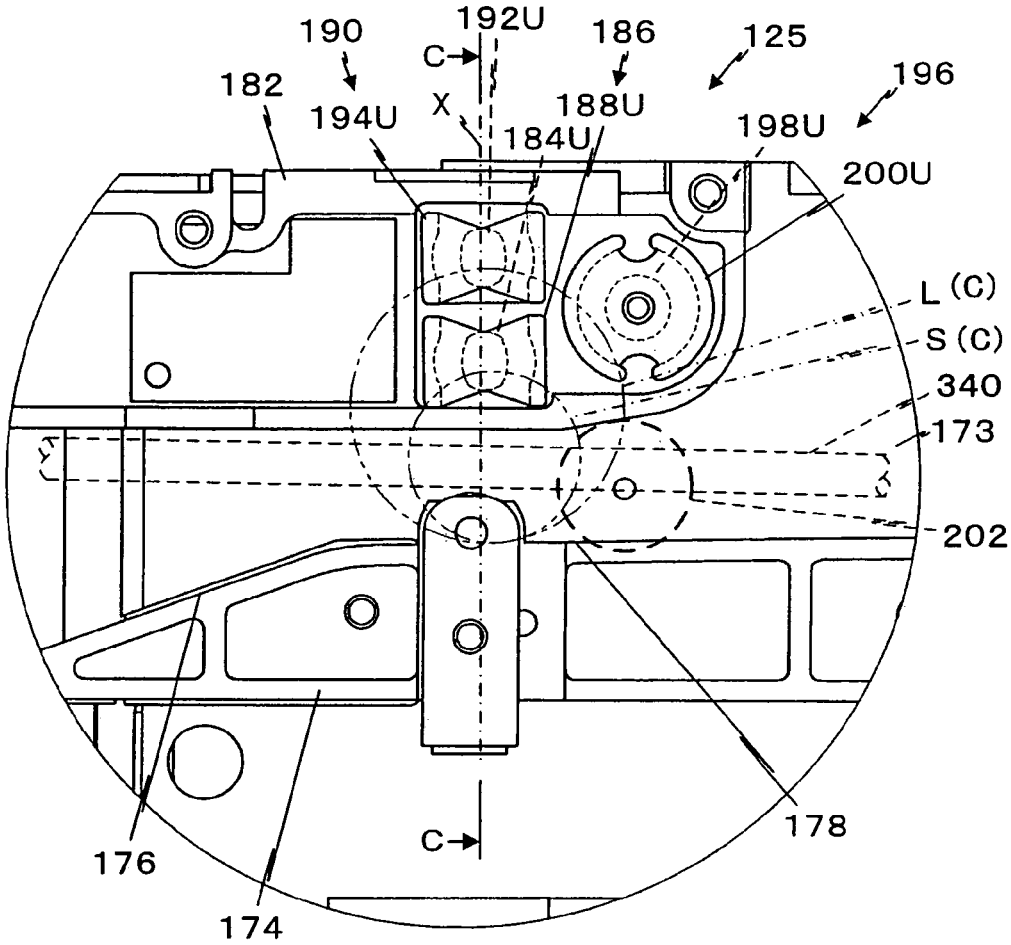
FIGS. 6A and 6B are an enlarged plan view and a cross section view along the line C-C of a denomination judging device of a coin receiving and disbursing apparatus embodying the present invention.
Figure 6:
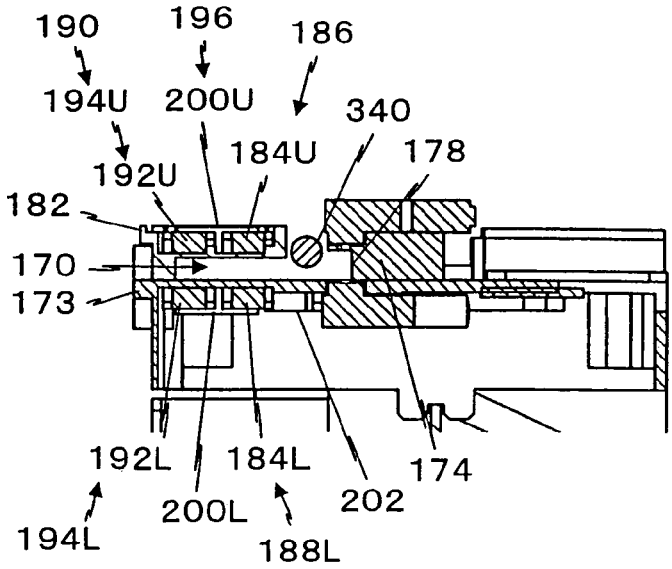

Furthermore, as shown in FIG. 6, a material sensor 202 for determining a material of a coin is attached on a bottom end of the slide base 173 and near the judgment guide part 178. Likewise the second diameter sensor 196, for example, the material sensor 202 is structured by winding a coil around a core. Since the core of the material sensor 202 lies near the judgment guide part 178, it faces the entire surface of the coin.

Figure 7:
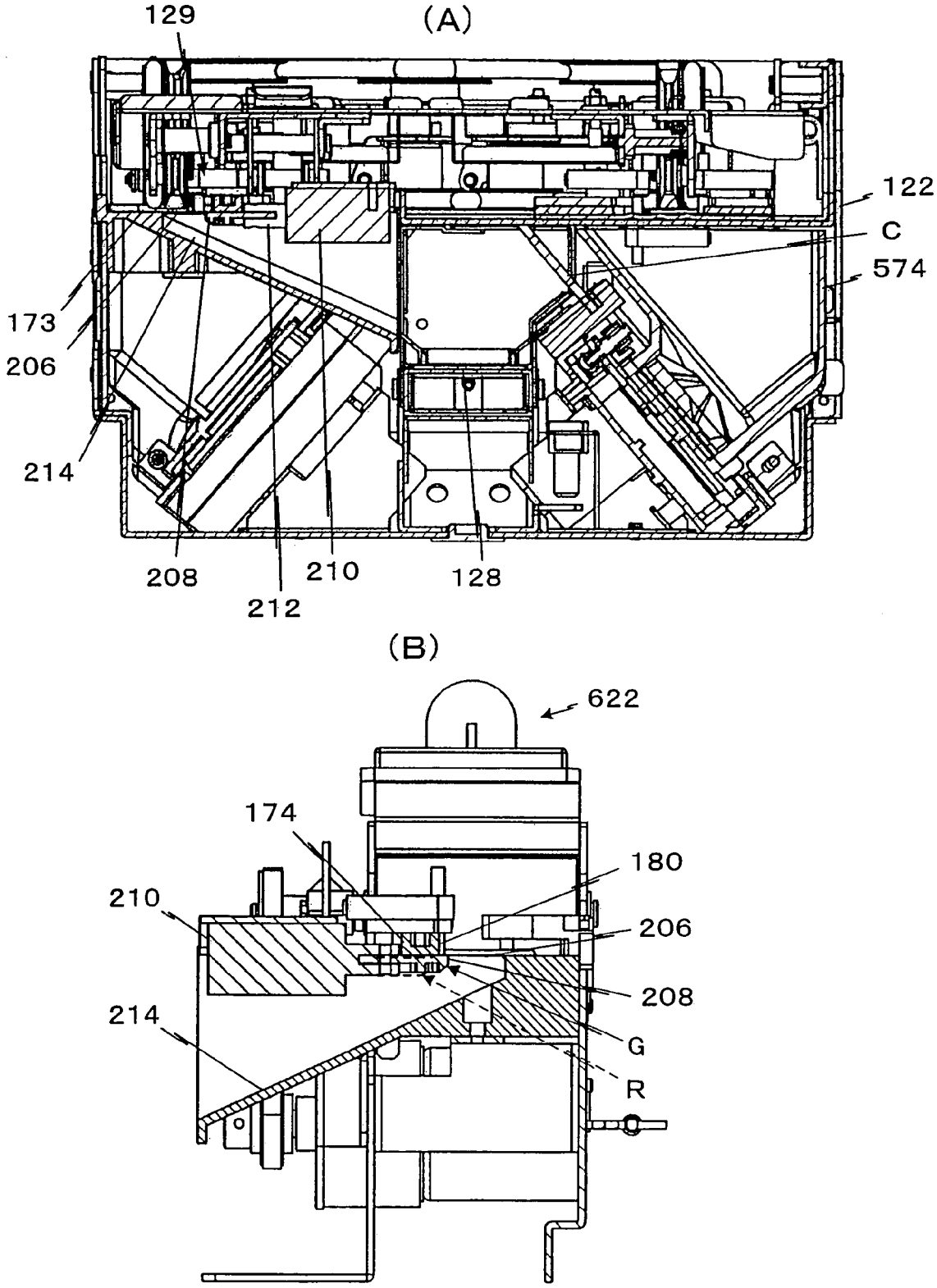
FIGS. 7A and 7B are an enlarged plan view and a cross section view taken along the line A-A in FIG. 2 of a coin receiving and disbursing apparatus embodying the present invention.

Next, explanation of a reject coin sorter 128 will be made with reference to FIG. 7. The reject coin sorter 128 is disposed downstream the denomination judging device 125. The reject coin sorter 128 sorts returning coins other than acceptable coins, as well as fake coins to the money discharging port according to the determination results by the denomination judging device 125.

In the present embodiment, the reject coin sorter 128 includes a dropping port 206 formed on the slide base 173 and a reject member 208 disposed below the first guide rail 174 of the dropping port 206. The dropping port 206 is so designed that the length along the traveling direction of coins is larger than the diameter of the coin having the largest diameter, and the length in the direction perpendicular to the reject guide part 198 of the dropping port 206 is slightly smaller than the diameter of the coin having the smallest diameter.

When the conveyance speed of a coin is high, the length in the traveling direction of coins is increased, preferably, to twice or more of the diameter of the coin having the largest diameter. When the length in the traveling direction of coins cannot be increased, it is preferred to add a drop assisting device for coins. The drop assisting device is, for example, a pusher that pushes a coin into the dropping port 206.

The reject member 208 is movable between a guiding position G at which the upper face thereof slightly projects from the reject guide part 180 toward the received money conveying path 132, and a reject position R at which the upper face thereof recedes under the first guide rail 174 from the reject guide part 180 at the dropping port 206 in a plane which is flush with the slide base 173.

The reject member 208 is moved between the guiding position C and the reject position R by a plunger 212 of a two-position solenoid 210 fixed to the slide frame 122. That is, whenever the solenoid 210 is excited, the reject member 208 is alternately switched between the guiding position G and the reject position R.

When the two-position solenoid 210 is used as described above, it is not necessary to continuously supply current in order to hold the reject member 208 at one of the guiding position G or the reject position R, leading an advantage of reduction of power consumption.

When the reject member 208 is in the reject position R, a coin moving on the dropping port 206 while guided by the reject guide part 180 of the first guide rail 174 drops through the dropping port 206, slides down on the bottom surface of the reject path 214, and is guided to the disbursing money conveying device 128 and returned to the money discharging port 110 because the lower face of the edge on the side of the reject guide part 180 of the coin is not guided. The reject path 214 inclines such that a coin slides down by its own weight toward the disbursing money conveying device 128 from below the dropping port 206.

Next, the sorting conveyance path 172 will be explained with reference to FIG. 3. The sorting conveyance path 172 sorts coins such that a predetermined denomination is sorted in a predetermined point during conveyance by the received money conveying device 124.

The sorting conveyance path 172 is formed into a substantially U-shape from a slide base 220, e.g. stainless steel plate, arranged substantially horizontally, a second guide rail 222, a U-turn guide rail 224 and a third guide rail 226 fixed on the top face of the slide base 220. A first support rail 228 is disposed parallel with the second guide rail 222 at a certain distance therefrom, a U-turn support rail 230 is disposed at a certain distance from the U-turn guide rail 224. A second support rail 232 is disposed parallel with the third guide rail 226 at a certain distance therefrom.

Each rail is formed from a plate slightly thicker than the coin having the largest thickness. Therefore, the sorting conveyance path 172 has a cross section of a shallow channel, and has a width which is slightly larger than the diameter of the coin having the largest diameter, and a thickness slightly larger than that of the coin having the largest thickness. The top face of the slide base 220 is formed with a plurality of protruding strips 234 extending in the longitudinal direction of the sorting conveyance path 172. This contributes to a reduction of friction when coins are conveyed by the received money conveying device 124 as will be described later.

However, the top face may be formed flat, for example, by bonding a low-friction sheet rather than providing the protruding strips as described above. As shown in FIG. 3, the received money conveying path 132 is formed into a U-shape from a path 236 leaving the money receiving port 104 which is opposite to the second guide rail 222, and is disposed downstream the judging and rejecting path 170. A U-turn path 238 opposite to the guide rail 224 and a path 240 approaching the money discharging port 110 along the third guide rail 226 is provided.

First, the leaving path 236 will be explained. The second guide rail 222 constituting the leaving path 236 is positioned on an extended line of the first guide rail 174. In other words, the second guide part 242 lies on an extended line of the reject guide part 180, and the second guide part 242 inclines at a slight acute angle with respect to the traveling direction D of coins.

The leaving path 236 is provided with a first coin sorting part or unit 244. In the present embodiment, the first sorting part 244 includes three denomination sorting parts, concretely, a one-cent sorting part 246, a two-cent sorting part 248 and a 10-cent sorting part 250. These sorting parts or units sort the coins conveyed along the second guide rail 222 by denomination. In the present embodiment, the sorting parts are respectively a one-cent sorting hole 252, a two-cent sorting hole 254 and a 10-cent sorting hole 256 which are substantially rectangular.

First, the one-cent sorting hole 252 will be explained. A one-cent guiding edge 258 near the second guide rail 222 of the one-cent sorting hole 252 lies in a position slightly closer to the leaving path 236 than the second guide rail 222, while a one-cent dropping edge 260 far from the same is slightly farther from the second guide rail 222 than the diameter of the a one-cent coin, and formed parallel with the second guide rail 222.

In other words, a one-cent coin will drop into the one-cent sorting hole 252 because the lower face of the periphery is not guided by the one-cent dropping edge 260. Coins having a diameter larger than the diameter of one-cent coin will pass through the one-cent sorting hole 252. This is because the lower face thereof is supported by the guiding edge 258 and the dropping edge 260.

Next, the two-cent sorting hole 254 will be explained. A two-cent guiding edge 262 near the second guide rail 222 of the two-cent sorting hole 254 lies in a position slightly closer to the leaving path 236 than the second guide rail 222, while a two-cent dropping edge 264 far from the same is slightly farther from the second guide rail 222 than the diameter of the a two-cent coin, and formed parallel with the second guide rail 222.

In other words, a two-cent coin will drop into the two-cent sorting hole 254 because the lower face of the periphery is not guided by the two-cent dropping edge 264. Coins having a diameter larger than the diameter of two-cent coin will pass through the two-cent sorting hole 254. This is because the lower face thereof is supported by the guiding edge 262 and the dropping edge 264.

Next, the 10-cent sorting hole 256 will be explained. A 10-cent guiding edge 266 near the second guide rail 222 of the 10-cent sorting hole 256 lies in a position slightly closer to the leaving path 236 than the second guide rail 222, while a 10-cent dropping edge 268 far from the same is slightly farther from the second guide rail 222 than the diameter of the a 10-cent coin, and formed parallel with the second guide rail 222.

In other words, a 10-cent coin will drop into the 10-cent sorting hole 256 because the lower face of the periphery is not guided by the 10-cent dropping edge 268. Coins having a diameter larger than the diameter of 10-cent coin will pass through the 10-cent sorting hole 256. This is because the lower face thereof is supported by the guiding edge 266 and the dropping edge 268. A corner on the downstream side of a dropping line 268 of the 10-cent sorting hole 256 is formed into an arc having almost the same curvature of the outer periphery of a 10-cent coin. This prevents coins other than 10-cent coins from dropping into the 10-cent sorting hole 256.

Next, the second sorting part 270 provided in the approaching path 240 will be explained. The second sorting part 270 is provided along the third guide rail 226. In the present embodiment, the second sorting part 270 includes five denomination sorting parts, namely, a five-cent sorting part 272, a 20-cent sorting part 274, a one-euro sorting part 276, a 50-cent sorting part 278 and a two-euro sorting part 280.

These sorting parts sort the coins conveyed along the third guide rail 226 by denomination. In the present embodiment, the sorting parts are respectively a five-cent sorting hole 282, a 20-cent sorting hole 284, a one-euro sorting hole 286, a 50-cent sorting hole 288 and two-euro sorting hole 290 which are substantially rectangular.

First, the five-cent sorting hole 282 will be explained. A five-cent guiding edge 292 near the third guide rail 226 of the five-cent sorting hole 282 lies in a position slightly closer to the approaching path 240 than the third guide rail 226, while a five-cent dropping edge 294 far from the same is slightly farther from the third guide rail 226 than the diameter of the a five-cent coin, and formed parallel with the third guide rail 226. In other words, a five-cent coin will drop into the five-cent sorting hole 282 because the lower face of the periphery is not guided by the five-cent dropping edge 294. Coins having a diameter larger than the diameter of five-cent coin will pass through the five-cent sorting hole 282. This is because the lower face thereof is supported by the guiding edge 292 and the dropping edge 294. A corner on the upstream side of a dropping line 294 of the 5-cent sorting hole 282 is formed into an arc having almost the same curvature of the outer periphery of a 5-cent coin. This prevents coins other than 5-cent coins from dropping into the 5-cent sorting hole 282.

Next, the 20-cent sorting hole 284 will be explained. A 20-cent guiding edge 296 near the third guide rail 226 of the 20-cent sorting hole 284 lies in a position slightly closer to the approaching path 240 than the third guide rail 226, while a 20-cent dropping edge 298 positioned far from the same is slightly farther from the third guide rail 226 than the diameter of the a 20-cent coin, and formed parallel with the third guide rail 226. In other words, a 20-cent coin will drop into the 20-cent sorting hole 284 because the lower face of the periphery is not guided by the 20-cent dropping edge 298. Coins having a diameter larger than the diameter of 20-cent coin will pass through the 20-cent sorting hole 284. This is because the lower face thereof is supported by the guiding edge 296 and the dropping edge 298.

Next, the one-euro sorting hole 286 will be explained. A one-euro guiding edge 300 near the third guide rail 226 of the one-euro sorting hole 286 lies in a position slightly closer to the approaching path 240 than the third guide rail 226, while a one-euro dropping edge 302 far from the same is slightly farther from the third guide rail 226 than the diameter of the a one-euro coin, and formed parallel with the third guide rail 226. In other words, one-euro coin will drop into the one-euro sorting hole 286 because the lower face of the periphery is not guided by the one-euro dropping edge 302. Coins having a diameter larger than the diameter of one-euro coin will pass through the one-euro sorting hole 286. This is because the lower face thereof is supported by the guiding edge 300 and the dropping edge 302.

Next, the 50-cent sorting hole 288 will be explained. A 50-cent guiding edge 304 near the third guide rail 226 of the 50-cent sorting hole 288 lies in a position slightly closer to the approaching path 240 than the third guide rail 226, while a 50-cent dropping edge 306 far from the same is slightly farther from the third guide rail 226 than the diameter of the a 50-cent coin, and formed parallel with the third guide frame 226. In other words, 50-cent coin will drop into the 50-cent sorting hole 288 because the lower face of the periphery is not guided by the 50-cent dropping edge 306. Coins having a diameter larger than the diameter of 50-cent coin will pass through the 50-cent sorting hole 288. This is because the lower face thereof is supported by the guiding edge 304 and the dropping edge 306.

Next, the two-euro sorting hole 290 will be explained. The two-euro sorting hole 290 is not formed on the slide base 220, but formed by the third guide rail 226 and the second support rail 232. In other words, all coins that have not dropped into the previous sorting holes will drop into the two-euro sorting hole 290.

The length of each sorting hole along the traveling direction of coins should be at least 1.5 times, preferably two times or more of the diameter of the coin of target denomination, in order to make a coin securely drop even when the conveyance speed of the coin is raised. The sorting holes of the present embodiment are arranged in order of increasing diameter among euro coins. The sorting part has a function of sorting a coin of particular denomination conveyed on the sorting conveyance path 172 in a particular position. Therefore, the sorting part may be replaced by another device having a similar function. For example, a coin of a certain denomination may be forcedly deviated from the sorting conveyance path by a solenoid pusher.

Figure 9:
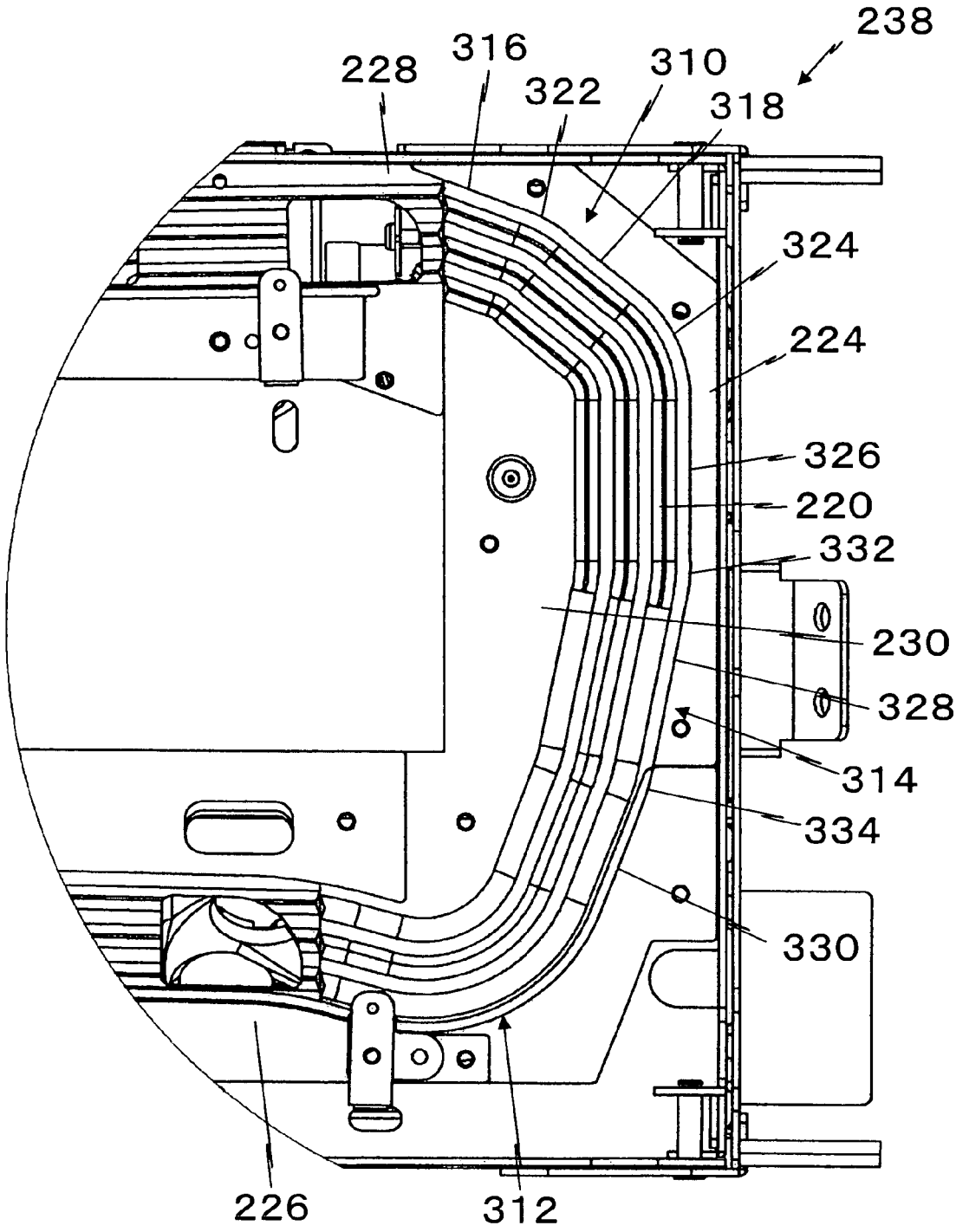
FIG. 9 is an enlarged plan view of a U-turn portion of a received money conveying path of a coin receiving and disbursing apparatus embodying the present invention.

Next, the U-turn path 238 will be explained with reference to FIG. 9. The U-turn path 238 guides a coin having passed through the leaving path 236 into the approaching path 240, namely, guides a coin having passed through the first sorting part 244 into a second sorting part 270.

The U-turn path 238 composed of the slide base 220, the U-turn guide rail 224 and the U-turn support rail 230 has a channel-like cross section, and is a U-shape groove when viewed two-dimensionally, and the groove has a depth and a width which are similar to those of the sorting conveyance path 172.

In order to smoothly guide a coin moving at high speed while preventing bouncing, the U-turn path 238 is so designed that an inlet part 310 on the side of the leaving path 236 is a relatively large arc, an outlet part 12 near the approaching path 240 is an arc having a smaller curvature than that of the inlet part 310, and an intermediate part 314 therebetween is an arc having a larger curvature than the inlet part 310.

The inlet part 310 is composed of a first linear segment 316 forming a blunt angle with the first support rail 228, a second linear segment 318 forming a blunt angle with first linear segment 316, and a third linear segment 326 forming a blunt angle with the second linear segment 318. These linear segments are smoothly connected by a first arcuate segment 322 and a second arcuate segment 324. Construction of the arcuate inlet part 310 by combination of the linear segments and arcuate segments allows the coins conveyed by the received money conveying device 124 as will be described below to be conveyed at a certain interval.

The intermediate part 314 is composed of a fourth linear segment 328 forming a blunt angle with the third linear segment 326, a fifth linear segment 330 forming a blunt angle with the fourth linear segment 328, a third arcuate segment 332 connecting the third linear segment 326 and the fourth linear segment 328, and a fourth arcuate segment 334 connecting between the fourth linear segment 328 and the fifth linear segment 330.

Therefore, the U-turn path 238 may be replaced by another structure having a similar function. However, construction from the slide base 220, the U-turn guide rail 224 and the U-turn support rail 230 is advantageous because it may be constructed at a low cost.

Next, the received money conveying device 124 that conveys a coin along the leaving path 236, the U-turn path 238 and the approaching path 240 will be explained. The received money conveying device 124 conveys a coin sent from the alignment device 130 along the received money conveying path 132.

In other words, it conveys a coin sent from the alignment device 130 along the judging and rejecting path 170, the leaving path 236, the U-turn path 238 and the approaching path 240, under the guidance by the first guide rail 174, the second guide rail 222, the U-turn guide rail 224 and the third guide rail 226 at a predetermined speed.

Figure 2:
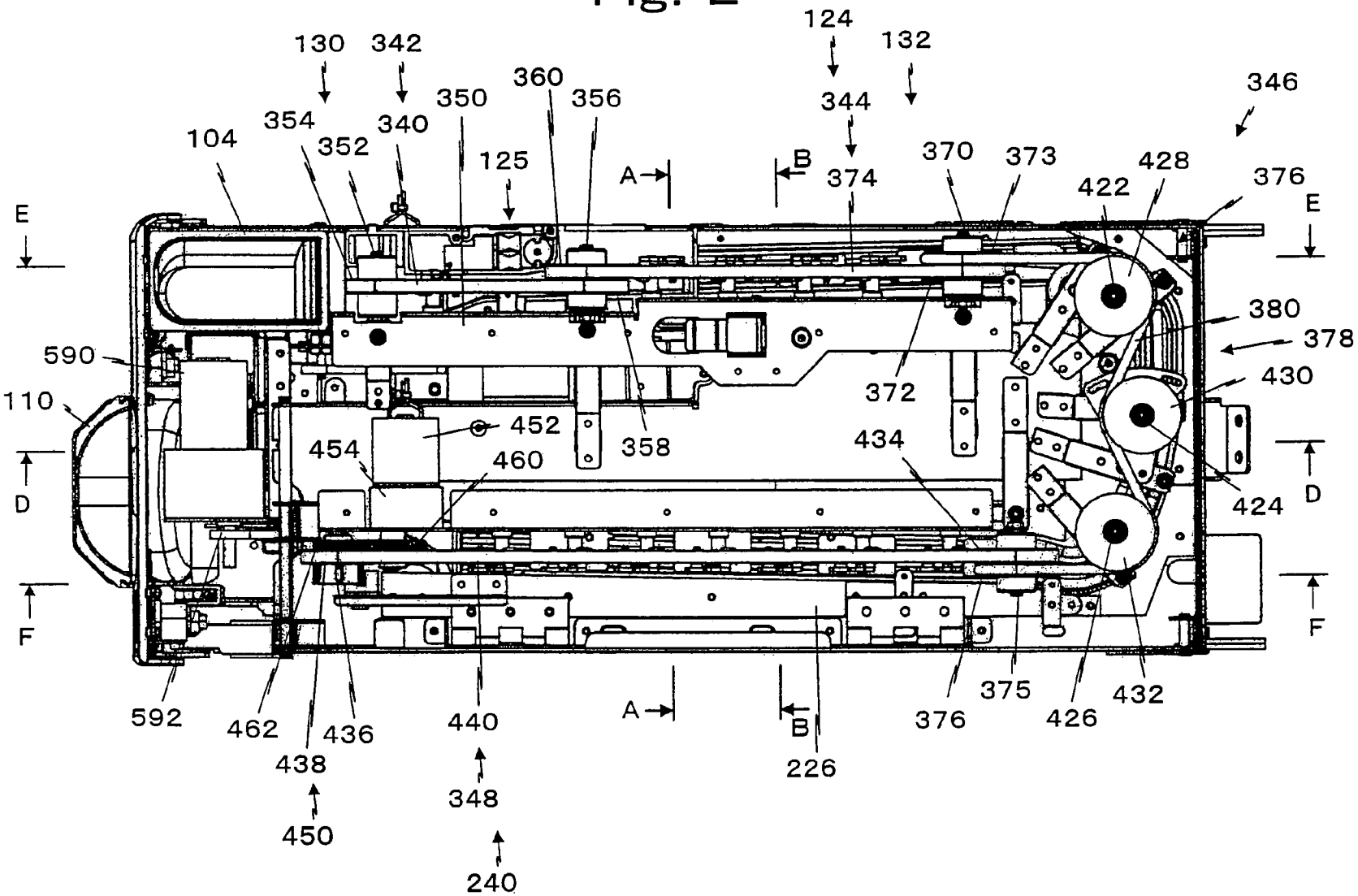
FIG. 2 is a plan view showing a coin receiving and disbursing apparatus embodying the present invention in a condition that a cover is removed.
Figure 3:
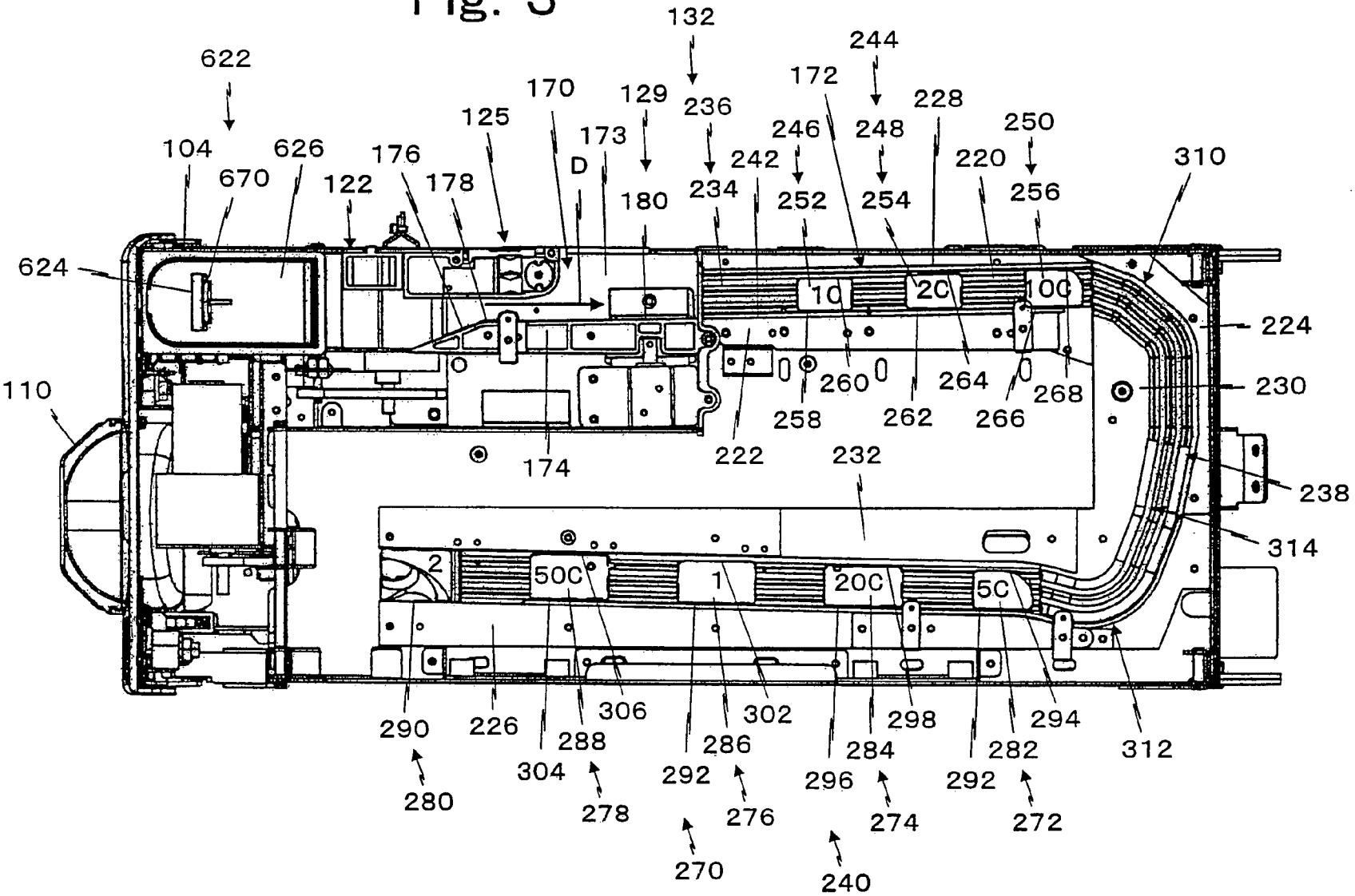
FIG. 3 is a plan view showing a received money conveying path of a coin receiving and disbursing apparatus embodying the present invention.

As shown in FIG. 2, the received money conveying device 124 includes a first conveying unit 342, a second conveying unit 344, a third conveying unit 346 and fourth conveying unit 348. The first conveying unit 342 is provided so as to face with the relay part 148 of the band conveyer 144 to the judgment guide part 178. The second conveying unit 344 is provided so as to face with the reject guide part 180, the one-cent sorting part 246 and the two-cent sorting part 248.

The third conveying unit 346 is provided so as to face with the 10-cent sorting part 250 and the U-turn guide rail 224. The fourth conveying unit 348 is provided so as to face with the five-cent sorting part 272, the 20-cent sorting part 274, the one-euro sorting part 276, the 50-cent sorting part 278 and the two-euro sorting part 280.

In the present embodiment, these conveying units are formed of a pulley and a belt, and conveys a coin by friction power between the belt and the coin. First, the details of the first conveying unit 342 will be explained with reference to FIG. 2.

The first conveying unit 342 includes a first pulley 354, a second pulley 358, and a first endless belt 340 wound around these pulleys. The first pulley 354 is rotatably attached to a first stationary axis 352 which extends perpendicular to a traveling direction of the belt 144 so as to be substantially parallel with a conveyer frame 350 above the relay part 148. The second pulley 358 is rotatably attached to a second stationary axis 356 which extends perpendicular to the longitudinal direction of the judging and rejecting conveyance path 170, so as to be substantially parallel with the slide base 173 between the denomination judging device 125 and the reject part 126 above the slide base 173.

The gap between the bottom face of the first belt 340 and the top face of the relay part 148 and the top face of the slide base 173 is smaller than the thickness of the thickest coin. In other words, the bottom face of the first belt 340 tilts forward so as to be closer to the top face of the slide base 173 as it comes closer to the reject coin sorter 128 and slightly tilts so as to be closer to the judgment guide part 178 and the reject guide part 180.

As shown in FIG. 6, a lower part of the first belt 340 is positioned between the first guide rail 174 and the sensor attachment 182, and the bottom face of the belt comes into contact with a top face of a coin, whereby the coin is moved by friction contact with the coin. The first belt 340 shifts a coin while contacting at the center in the case of a coin S having the smallest diameter, or contacting at a portion closer to the first guide rail 174 rather than the center in the case of a coin L having the largest diameter.

In other words, it is provided so as to contact the center or the point closer to the first guide rail 174 of a coin to be conveyed in a position opposite to the denomination judging device 125. This arrangement and combination of the first diameter sensor 186, the second diameter sensor 196 and the third diameter sensor 190 make it possible to accurately detect diameters of various sizes of coins that are conveyed in a mixed state. The lower belt of the first belt 340 is pushed against the slide base 173 by means of a pushing device 360.

Figure 10:
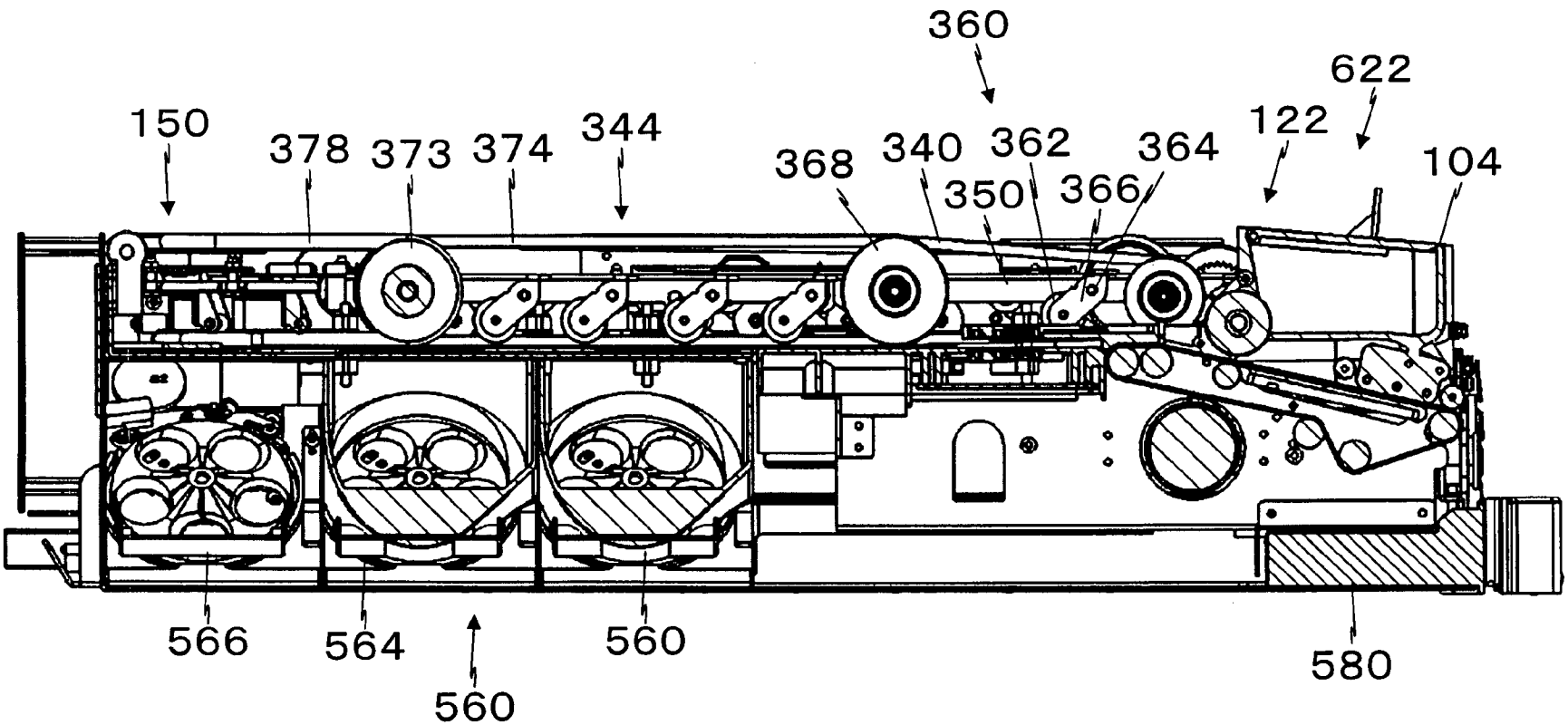
FIG. 10 is a cross section view taken along the line E-E in FIG. 2.

As shown in FIG. 10, in the pushing device 360, a press roller 362 is applied on the first belt 340 from above. The press roller 362 is rotatably attached in a lower end part of a lever 366 which is rotatably attached to the axis 364 projecting in the lateral direction from the conveyance frame 350. The lever 366 is latched by a stopper (not shown), and a lower end of the first belt 340 has a certain interval with the slide base 173.

The lever 366 is urged so as to be rotatable in the counter clockwise direction by a string-wound spring. Therefore, the first belt 340 between the first pulley 354 and the second pulley 358 is pushed against the slide base 173 with a certain power. In other words, a coin is pushed against the slide base 173 with certain power by the first belt 340.

Next, the second conveying unit 344 will be explained with reference to FIG. 2. The second conveying unit 344 includes a third pulley 368 formed integrally with the second pulley 358 and provided in a position farther from the first guide rail 174 than the second pulley 358, a fourth pulley 372 rotatably attached to a third stationary axis 370 extending perpendicular to the leaving path 236 and disposed between the two-cent sorting part 248 and the 10-cent sorting part 250, and a second endless belt 374 wound around the third pulley 368 and the fourth pulley 372.

The gap between the bottom face of the second belt 374 and the top face of the slide base 173 and the top face of the slide base 220 of the leaving path 236 is smaller than the thickness of the thinnest coin. To be more specific, the bottom face of the second belt 347 tilts forward so as to be closer to the top face of the slide bases 173 and 220 as it comes closer to the 10-cent sorting part 250 and slightly tilts so as to be closer to the second guide rail 222.

The pushing device 360 as described above is provided also for a lower belt of the second belt 374. The pushing device 360 is provided in plural at a predetermined interval, such as an interval similar to that of coins resulting from difference in speed between the band conveyer 134 and the first conveying unit 342. That is, when coins are continuously sent, the interval of coins is kept by pushing such coins almost simultaneously with the pushing devices 360.

Next, the third conveying unit 346 will be explained with reference to FIG. 2. The third conveying unit 346 includes a fifth pulley 373 formed integrally with the fourth pulley 372 and provided in a position farther from the second guide rail 222 than the fourth pulley 372, a sixth pulley 376 rotatably attached to a fourth stationary axis 375 extending perpendicular to the approaching path 240 directly before the approaching path 240 or above the outlet part 312 and disposed directly before the five-cent sorting part 272, a curve part guiding device 378 for conveying a coin along the U-turn path 238, and a third endless belt 380 wound around the fifth pulley 373 and the sixth pulley 376 and guided by the curve part guiding device 378.

Figure 11:
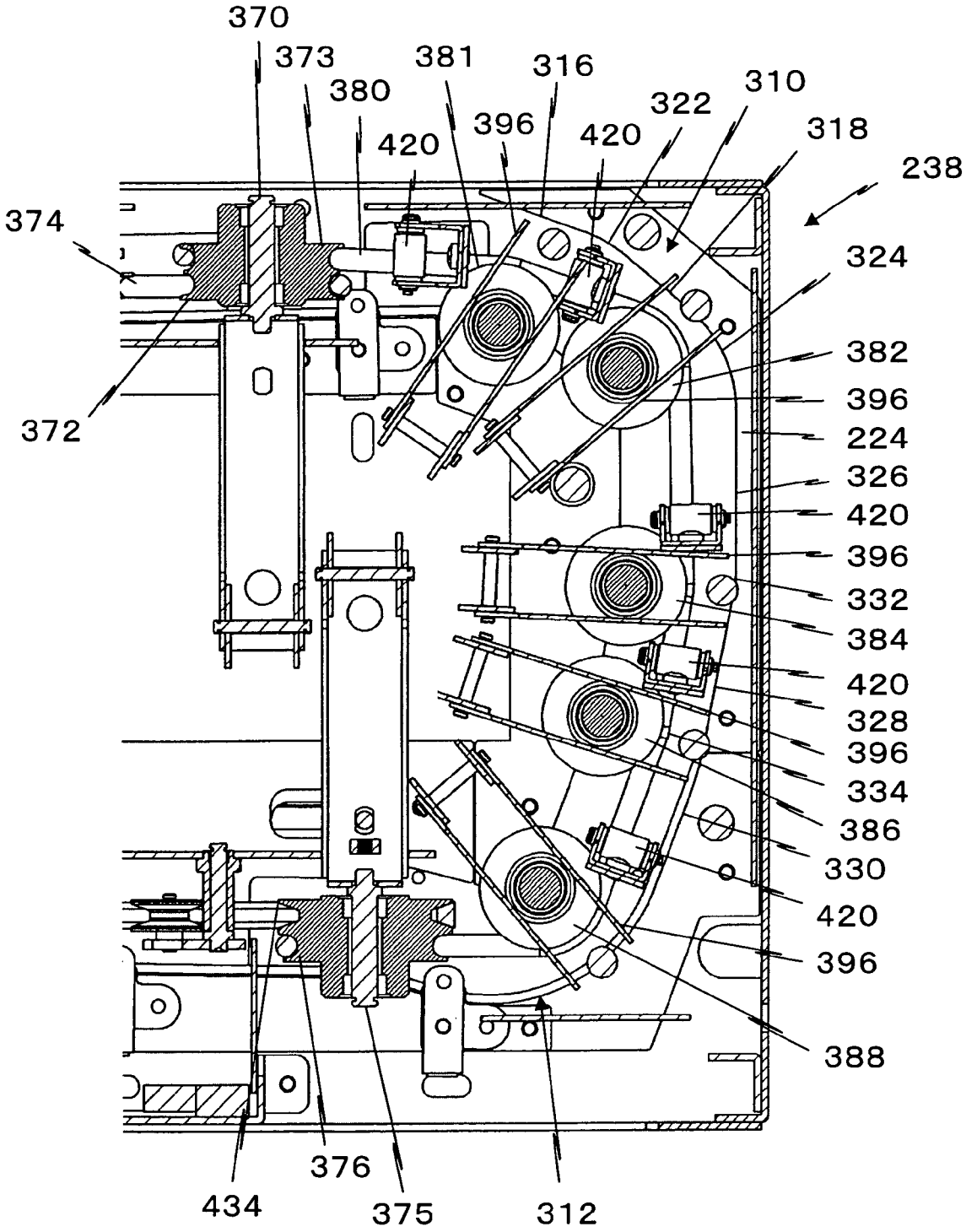
FIG. 11 is an enlarged plan view of a curve part guiding device of a coin receiving and disbursing apparatus embodying the present invention.
Figure 12:
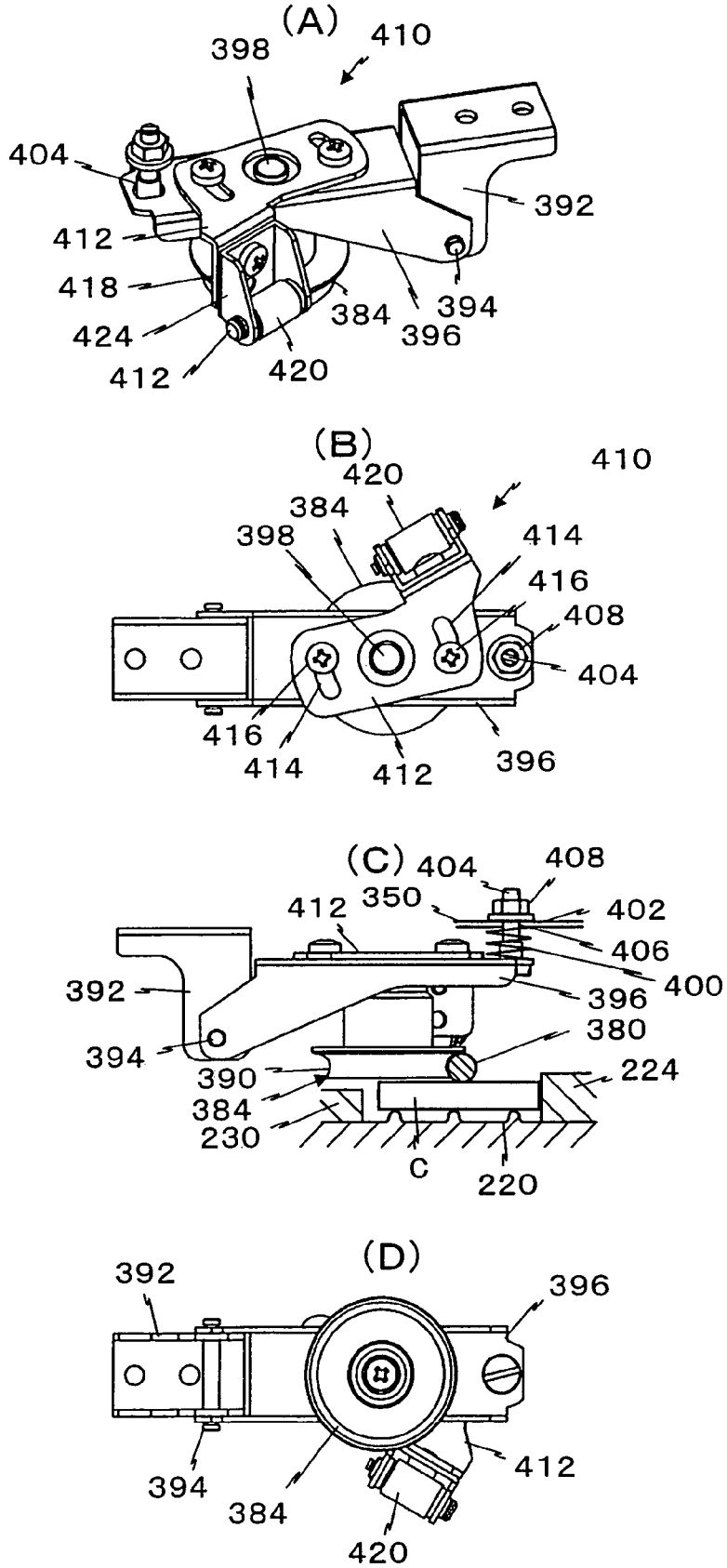

As shown in FIG. 11, the curve part guiding device 378 includes a first guide roller 381, a second guide roller 382, a third guide roller 384, a fourth guide roller 386 and a fifth guide roller 388 closely provided above the slide base 220. All of these first guide roller 381 to fifth guide roller 388 are formed in the same manner, and explanation will be made on the third guide roller 384 shown in FIG. 12, representatively.

The third guide roller 384 is provided so that a guide groove 390 for the third belt 380 is formed to have a J-shaped cross section, and the lower end of the third belt 380 is positioned closer to the slide base 220 than the bottom face of the third guide roller 384. The third guide roller 384 is rotatably supported by a vertical axis 398 fixed to a support lever 396 pivotably supported by a stationary axis 394 attached horizontally to a stay 392 fixed to the conveyance frame 350.

The support lever 396 is urged in the clockwise direction by a spring 400 provided between the conveyance frame 350 and the lever, and is so configured that the support lever 396 is stopped at a stopper part 402 of the conveyance frame 350 and the bottom face of the third belt 380 keeps a predetermined interval with the top face of the slide base 220 which is smaller than the thickness of the thinnest coin.

A screw bar 404 is rotatably attached to an end of the support lever 396 to inhibit it from sliding in the axial direction. This screw bar 404 is screwed into a screw hole 406 of the conveyance frame 350 and axially fixed by a lock nut 408. The spring 400 is provided outside the screw bar 404.

The support lever 396 is attached with a third guide roller automatic positioning unit 410. The guide roller automatic positioning unit 410 automatically adjusts the distance of the third guide roller 384 from the slide base 220 in correspondence with the thickness of the coin, and moves the coin along the U-turn path 238 at a predetermined speed.

A first stay 412 is attached so as to be rotatable about the vertical axis, and fixed by a screw 416 penetrating through a arcuate slot 414. The first stay 412 has a vertical portion 418 hanging down in a position deviated from the support lever 396, and is attached with a roller stay 424 so as to allow positioning in an up-and-down direction. To the roller stay 424, a feeler roller 420 is rotatably attached by an axis 422.

A lower end of the feeler roller 420 is designed to come into contact with an upper part of the third belt 380 on the upstream side of the third roller 384 which is not in contact with a coin. The feeler roller 420 is adjusted by a range of the arcuate slot 414 so that its rotational axis is perpendicular to the third belt 380 when viewed two-dimensionally.

With this structure, when the third belt 380 is pushed up by a coin, the feeler roller 420 is pushed up by the third belt 380, and hence the support lever 396 is pushed up via the roller stay 424 and the first stay 412, so that the position of the third guide roller 384 is automatically adjusted in correspondence with the thickness of the coin.

As shown in FIG. 11, in general, the first guide roller 381 is disposed so as to face with the first arcuate segment 322, the second guide roller 382 is disposed so as to face with the second arcuate segment 324, the third guide roller 384 is disposed so as to face with the third arcuate segment 332, the fourth guide roller 386 is disposed so as to face with the fourth arcuate segment 334, and the fifth guide roller 388 is disposed so as to face with the outlet part 312.

As a result, the third belt 380 is linear in shape between each guide roller, and such linear segments face with the first linear segment 316, the second linear segment 318, the third linear segment 326, the fourth linear segment 328 and the fifth linear segment 330. Then these linear segments of the third belt 380 are slightly inclined so as to come closer to each linear segment of the U-turn guide rail 224 as they proceed in the downstream direction.

With this structure, a coin conveyed along the U-turn path 238 is conveyed while being guided by the U-turn guide rail 224. As shown in FIG. 2, the upper part of the third belt 380 is guided by pulleys 428, 430, 432 rotatably attached to stationary axes 422, 424, 426 fixed to the conveyance frame 350.

Therefore, the third belt 380 circulates while being guided by the fifth pulley 373, the first guide roller 381, the second guide roller 382, the third guide roller 384, the fourth guide roller 386, the fifth guide roller 388, the sixth pulley 376, and the guide pulleys 432, 430, 428.

Figure 13:
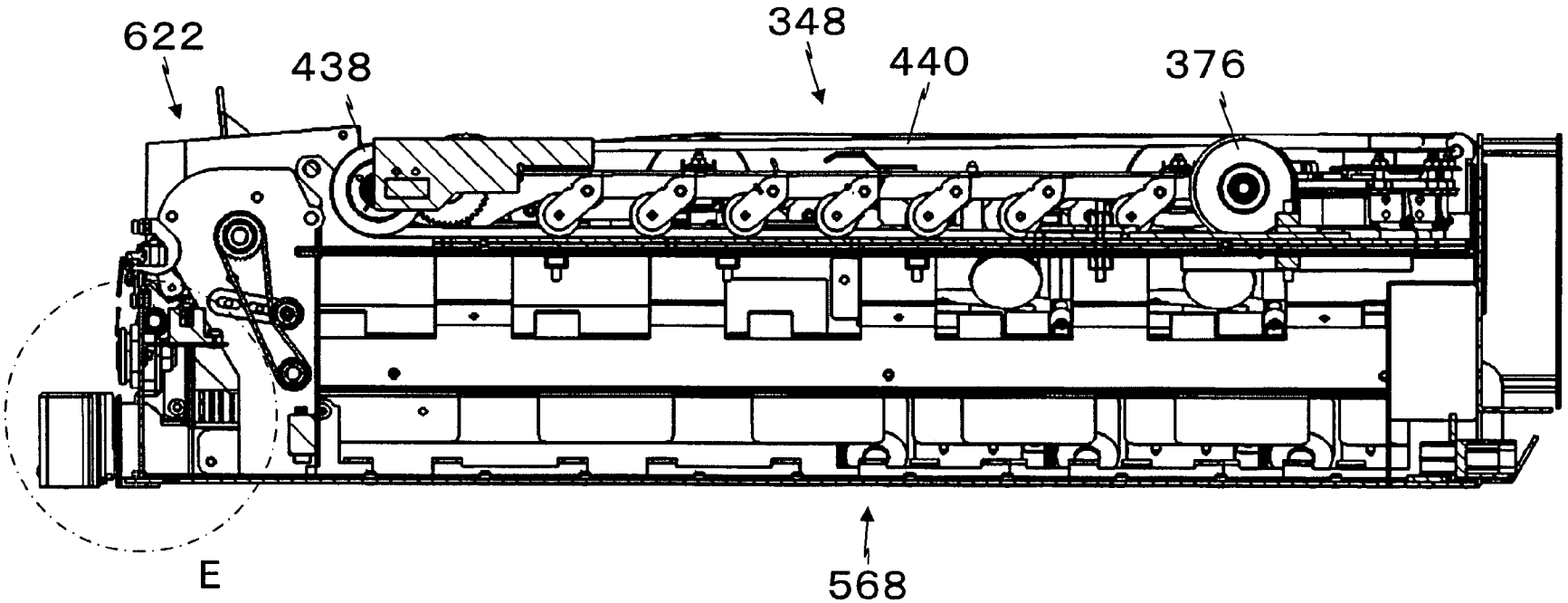
FIG. 13 is a cross section view taken along the line F-F in FIG. 2.

Next, the fourth conveying unit 348 will be explained with reference to FIG. 2 and FIG. 13. The fourth conveying unit 348 includes a seventh pulley 434 formed integrally with the sixth pulley 376 and provided in a position farther from the third guide rail 226 than the sixth pulley 376, an eighth pulley 438 rotatably attached to a driving axis 436 extending perpendicular to the approaching path 240 and disposed downstream the two-cent sorting part 280, and a fourth endless belt 440 wound around the seventh pulley 434 and the eighth pulley 438.

The gap between the bottom face of the fourth belt 440 and the top face of the slide base 220 of the approaching path 240 is smaller than the thickness of the thinnest coin. To be more specific, the bottom face of the fourth belt 440 tilts to approach the third guide rail 226.

Further, the fourth belt 440 is disposed so as to face with the five-cent sorting part 272, the 20-cent sorting part 274, the one-cent sorting part 276, the 50-cent sorting part 278 and the two-euro sorting part 280. Likewise the above, the fourth belt 440 pushes a coin against the slide base 220 with predetermined power by means of the pushing device 360.

The second pulley 358, the third pulley 360, the fourth pulley 372, the fifth pulley 373, the sixth pulley 376 and the seventh pulley 434 have the same diameter. This makes it possible to use the same specification of pulleys for these pulleys, which is advantageous in terms of cost. These belts may be a round belt, a V belt or a flat belt made from polyurethane rubber.

Next, a driving device 450 of the received money conveying device 124 will be explained with reference to FIG. 2. On the top face of the conveyance frame 350, an electric motor 452 is fixed, and a driving gear 460 fixed on an output axis (not shown) of a reducer 454 meshes with a driven gear 462 formed integrally with the eighth pulley 438. Therefore, as the electric motor 452 rotates, the eighth pulley 438 rotates in the clockwise direction in FIG. 13, and the fourth belt 440 is circulated in the clockwise direction.

As a result, the sixth pulley 376 is rotated integrally with the seventh pulley 434, and the third belt 380 is circulated in the same direction. Further, since the fourth pulley 372 is rotated integrally with the fifth pulley 373 by the third belt 380, the second belt 374 is circulated in the same direction. Furthermore, since the second pulley 358 is rotated integrally with the third pulley 360, the first belt 340 is circulated in the same direction.

In other words, the third conveying unit 346 is driven by friction transmitted from the fourth conveying unit 348, the second conveying unit 344 is driven by friction transmitted from the third conveying unit 346, and the conveying unit 342 is driven by friction transmitted from the second conveying unit 344. Since each conveying unit has a respective friction resistance, the conveyance speed of the fourth conveying unit 348 is largest, and the he conveyance speed decreases in the order of the third conveying unit 346, the second conveying unit and the first conveying unit 342.

As a result, the conveying speed of a coin decreases in the order of a higher speed from the order of the fourth conveying unit 348, the third conveying unit 346, the second conveying unit 344, and the first conveying unit 342. In other words, since a coin is conveyed at higher speed in a conveying unit located more downstream, the interval of successively conveyed coins becomes sequentially larger. As a result, a jam resulted from a following coin catching up with an upstream coin will not likely occur.

Next, the coin storing device 126 provided below the slide base 122 of the present invention will be explained with reference to FIG. 4. The coin storing device 126 stores coins having been sorted by the denomination-based sorting units by denomination. More specifically, a coin storing and releasing device 470 is provided for each denomination.

The coin storing and releasing device 470 stores coins in bulk, and releases the reserved coins one by one. Therefore, the coin storing and releasing device 470 may be replaced by another device having a similar function.

In the present embodiment, the coin storing and releasing device 470 is implemented by a coin hopper 472. As schematically shown in its view of FIGS. 14A through 14F, the coin hopper 472 includes a base 474 provided diagonally, a rotary disc 476, a reserving bowl 478, a release or flicking unit 480, a coin sensor 482, a driving motor 484 and a frame 486. The base 474 has a box-like form in which a decelerating mechanism 488 and the like are disposed.

The base 474 is fixed in a slope part of the frame 486 which is right triangle when viewed laterally and inclined at about 45 degrees. The smaller the angle of inclination, the more it is preferred because the reserving capacity of coins of the hopper bowl 476 increases. However, the minimum inclination angle is about 30 degrees because the degree of influence of the diameter of the rotary disc 476 on the size of the coin hopper 472 increases, and the maximum inclination angle is about 60 degrees because the propelling efficiency of the released coin is deteriorated if the inclination angle is too large.

On the top face of the base 474, the hopper bowl 478 of a cylindrical shape is detachably fixed. The lower part of the hopper bowl 478 is formed with a circular hole 490 and an upper opening 492 is rectangular in order to increase the coin reserving capacity. The rotary disc 476 has a plurality of through holes 491 provided at a predetermined interval, an angle stirrer 494 in the center of the top face, and a coin pushing part 496 in the bottom face.

Figure 14:
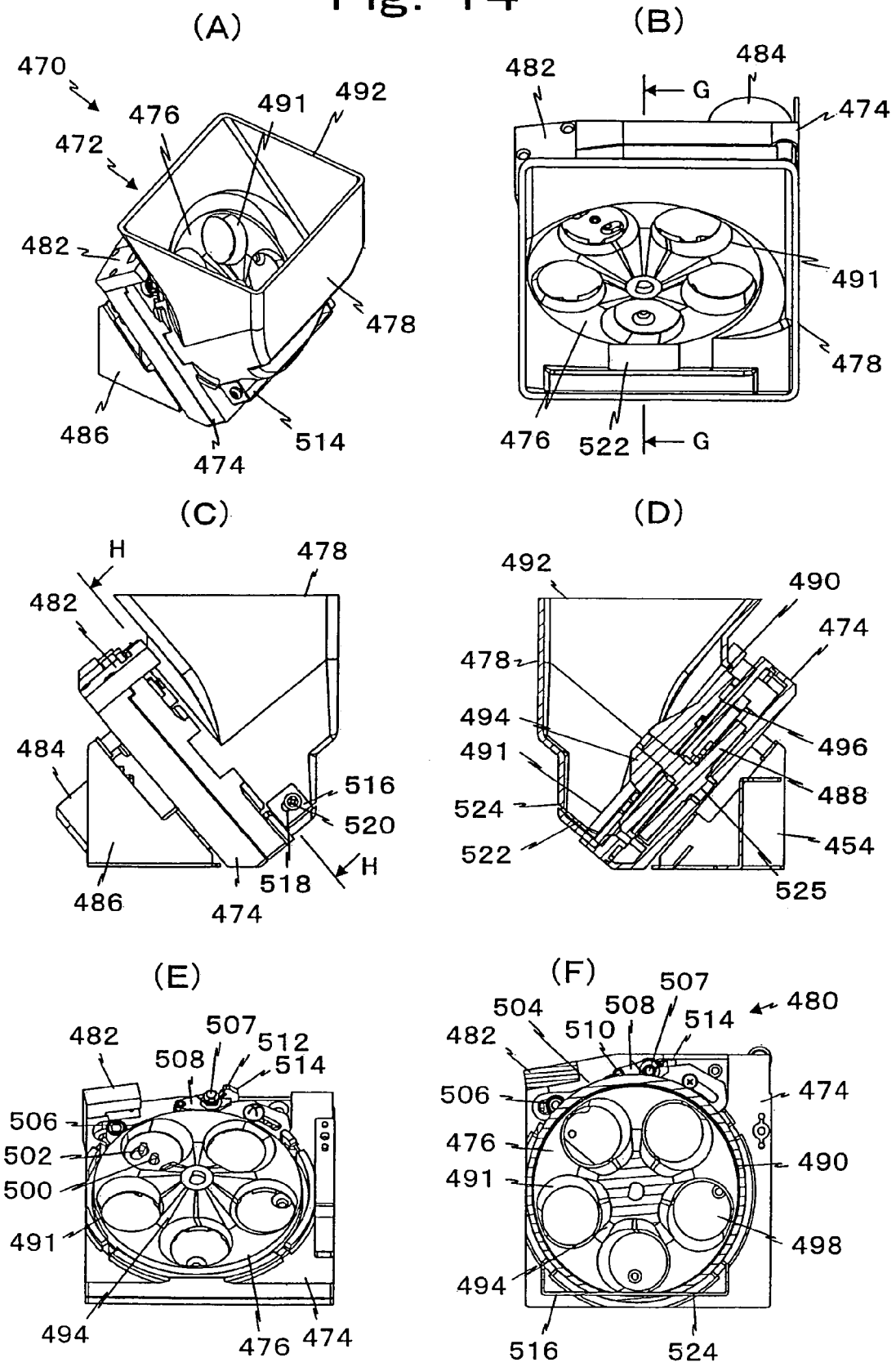

Therefore, the coin dropping through the through hole 491 is held by the upper face 498 of the base 474, and in a normal state, rotated in the counter clockwise direction together with the rotary disc 476 by the pushing part 496 of the rotary disc 476 normally rotating in the counter clockwise direction as shown in the views of FIG. 14, while guided by the circular hole 40 at the periphery. The coin is prevented from moving by pins 500, 502 protruding in predetermined positions of the top face of the base 474, and pushed in the circumferential direction of the rotary disc 476.

Since the circular hole 490 is notched at this position, and an opening 504 is provided, see FIG. 14(F), the coin that is pushed out can move outside the hopper bowl 478. The opening 504 is provided with a stationary guide roller 506 in the releasing unit 480.

The releasing unit 480 has a roller 510 that is rotatably attached to an end of a lever 508 pivotably attached to a stationary axis 507, and the lever 508 is urged so as to approach the rotary disc 476 by a string-wound spring 512. The lever 508 is latched by a stopper 514 at the position where the roller 510 comes close to the rotary disc 476, and is held at a standby position.

The gap between the stationary guide roller 506 and the roller 510 in their standby positions is smaller than the diameter of the coin being reserved. Since the coin pushed by the pushing part 496 is guided on its either side by the stationary guide roller 506, the roller 510 is moved in the clockwise direction in FIG. 14(F). Then immediately after the diametrical part of the coin has passed between the stationary guide roller 506 and the roller 510, the lever 508 is quickly rotated in the counterclockwise direction by the spring 512, and the coin is propelled outward and upward by a striking force from the lever 508 to extend over the money discharging belt 584.

In other words, the coin is flicked out diagonal upwardly because it is propelled out along the base 474. The circular hole 490 in the lower part of the hopper bowl 478 is provided with a coin dropper 516. The coin dropper 516 allows a coin that rotates integrally with the rotary disc 476 while a surface part thereof is in close contact with the peripheral surface of the circular hole 490 and a circumferential edge of thereof rides on an edge of the rotary disc 476, to drop through the through hole 491.

The coin dropper 516 is formed into a channel form from a metal plate, and has a slot 518 on each end. The coin dropper 516 is attached to a lateral wall of the hopper bowl 478 in such a manner that allows positional adjustment along the axial line of the circular hole 490 by a screw 520 penetrating through the slot 518. An intermediate part 522 of the coin dropper 516 extends along the axial line of the circular hole 490 at one end of the hopper bowl 478, and inserted through a slit 524 formed in proximity to the wall face of the circular hole.

As a result, the intermediate part 522 lies directly above the edge of the rotary disc 476 in the circular hole 490. To be more specific, the distance between the inner face of the intermediate part 522 and the outer lateral line of the through hole 491 of the rotary disc 476 is set so as to be one half or less of the thickness of the coin being reserved. It is preferred that the inner face of the intermediate part 522 overlaps the periphery of the through hole 491 when the rotary disc 476 is viewed two-dimensionally.

As a result, when a coin is to be rotated integrally with the rotary disc 476 on the edge of the rotary disc 476, the coin is forced to move toward the through hole 491 by the intermediate part 522 of the coin dropper 516, and the coin drops through the through hole 491 because the edge of the rotary disc 476 is substantially absent. This enables disbursement through to the last coin in the hopper.

Further, the rotary disc 476 is attached to the upper end of the rotational axis 525 which is rotatably fixed to the base 474 in such a manner that it is axially slidable but rotation relative to the rotational axis 525 is inhibited. In other words, by intervening the rotary disc 476 and the top face 498 of the base 474 with a RIM having low coefficient of friction, it is possible to adjust the distance therebetween and positioning the rotary disc 476 depending on the thickness of the coin.

In this case, by adjusting the position of the top face of the rotary disc 476 and the intermediate part 522 of the coin dropper 516 within the range of the slot 518, it is possible to realize the optimum positional relationship.

The position adjusting device of the rotary disc 476 with respect to the thickness of the coin may be replaced by a device other than the rim described above having a similar function. Also the position adjusting mechanism of the coin dropper 516 may be replaced by another device having a similar function.

The coin sensor 482 is a sensor for detecting a coin that is flicked by the flicking unit 480, and may be implemented by a proximity sensor, an optical sensor and the like. However, it is preferred to use a proximity sensor because of its insusceptibility to dust and low maintenance.

Figure 4:
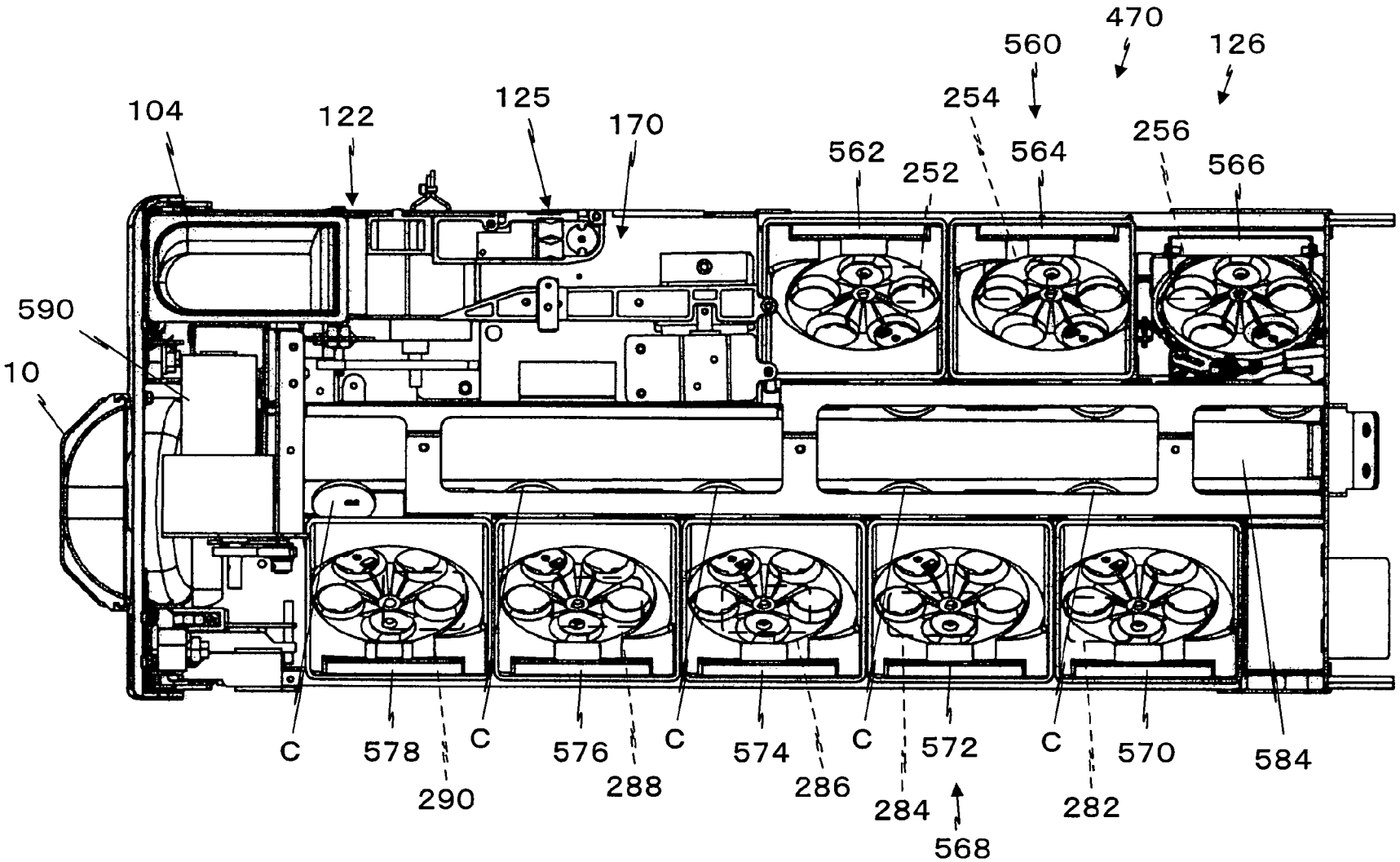
FIG. 4 is a plan view showing arrangement of hoppers of a coin receiving and disbursing apparatus embodying the present invention.

The coin hopper having the above structure is arranged in line along the path 236 below the first sorting part 244 of the leaving path 236 as shown in FIG. 4, to constitute a first hopper array 560. The first hopper array 560 is made up of a one-cent hopper 562 disposed below the one-cent sorting part 246, a two-cent hopper 564 disposed below the two-cent sorting part 248 and a 10-cent hopper 566 disposed below the 10-cent hopper 250.

Figure 15:
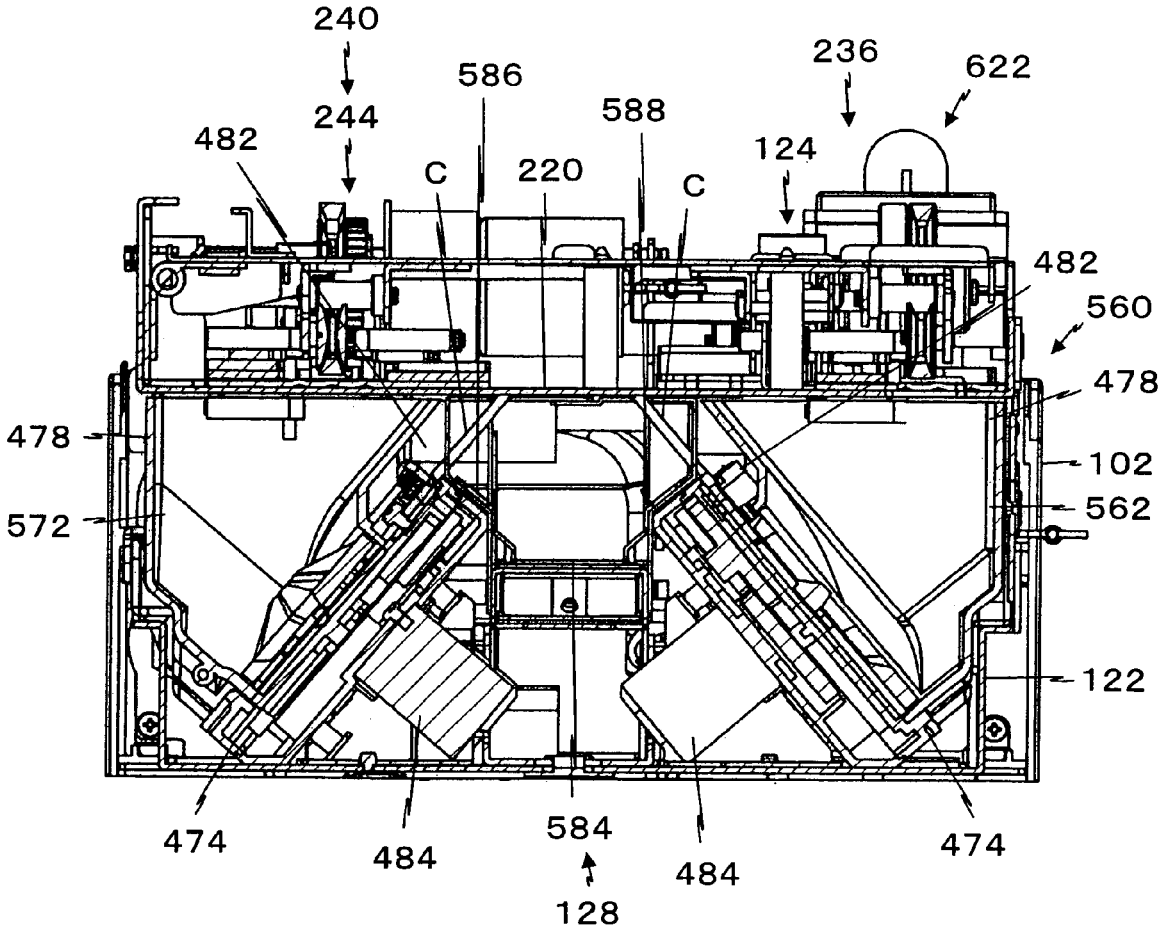
FIG. 15 is a cross section view along the line B-B of FIG. 2.

As shown in FIG. 15, an upper opening 492 of a hopper bowl 478 of the one-cent hopper 562 is disposed below the one-cent sorting hole 252, an upper opening 492 of the two-cent hopper 564 is disposed below the one-cent sorting hole 254, and an upper opening 492 of the 10-cent hopper 566 is disposed below the 10-cent sorting hole 254. In this manner, by dropping coins directly from each sorting hole to the upper opening 492 of the hopper, it is possible to reduce the height of the processing device while reducing the costs.

As shown in FIG. 4, below the second sorting part 270 in the approaching path 240, a second hopper array 568 is provided along the approaching path 240. In other words, when viewed two-dimensionally, the first hopper array 560, the disbursing money conveying device 128 and the second hopper array 568 are arranged in parallel.

The second hopper array 568 is made up of a five-cent hopper 570 disposed below the five-cent sorting part 272, a 20-cent hopper 572 disposed below the 20-cent sorting part 274, a one-euro hopper 574 disposed below the one-euro sorting part 276, a 50-cent hopper 576 disposed below the 50-cent sorting part 278, and a two-euro hopper 578 disposed below the 2-euro sorting part.

An upper opening 492 of a hopper bowl 478 of the five-cent hopper 570 is disposed below the five-cent sorting hole 282, an upper opening 492 of the 20-cent hopper 572 is disposed below the 20-cent sorting hole 284, an upper opening 492 of the one-euro hopper 274 is disposed below the one-euro sorting hole 286, an upper opening 492 of the 50-cent hopper 576 is disposed below the 50-cent sorting hole 288, and an upper opening 492 of the two-euro hopper 578 is disposed below the two-euro sorting hole 290.

The hoppers of the first hopper array 560 and the hoppers of the second hopper array 568 are symmetrically disposed at predetermined intervals while intervened by the disbursing money or coin conveying device 128 as shown in FIG. 15. In other words, the base 474 is symmetrically arranged as is an isosceles triangle, and coins are flicked out toward the opposing hopper arrays upwardly and diagonally. As a result, the momentum of the flicked out coin is attenuated by the gravity, and the coin drops into the disbursing money conveying device 128 after striking against the backside of the slide base 220.

Further, the coin hopper 472 of the first hopper array 560, and a part of the coin hopper 472 of the second hopper array 568 overlap with respect to the disbursing money conveying device 128 in the lateral direction. To be more specific, a part of the driving motor 484 and the disbursing money conveying device 128 overlap with each other. This is advantageous in that the width of the coin receiving and disbursing apparatus 100 may be reduced.

Figure 8:
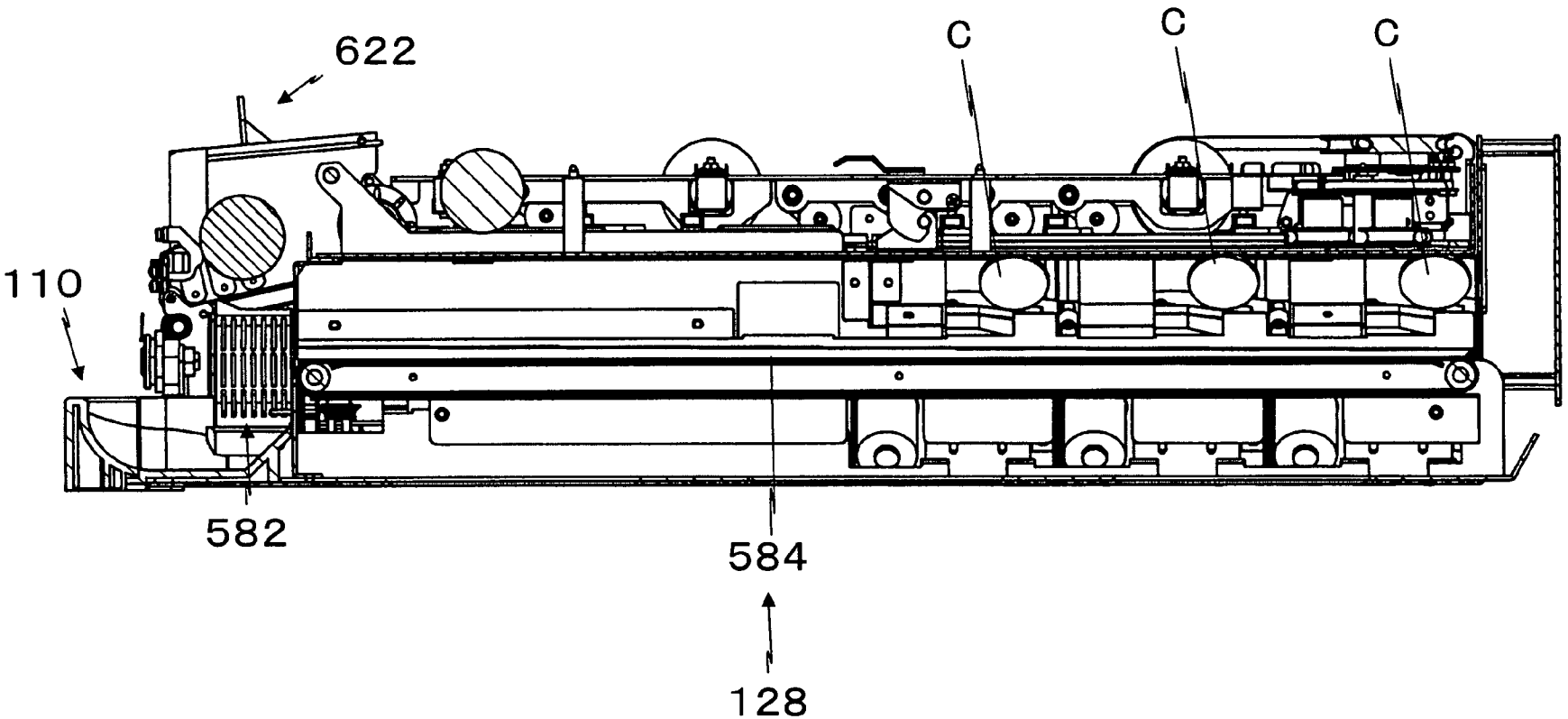
FIG. 8 is a cross section view taken along the line D-D in FIG. 2.

Next, the disbursing money conveying device 128 will be explained with reference to FIG. 8. The disbursing money conveying device 128 conveys coins flicked out from the coin hoppers 562, 564, 566, 570, 572, 574, 576 and 578, and coins rejected in the reject coin sorter 128 to the money discharging port 110. In the present embodiment, when each coin hopper is filled, coins flicked out from the filled coin hopper are conveyed to the money discharging port 110 or a distributing unit 582 of the cash box 112 in order to store the coins in the cash box 112.

The disbursing money conveying device 128 is a money discharging belt 584, and substantially horizontally disposed along the first hopper array 560 and the second hopper array 568. Further, as shown in FIG. 15, the top face of the money discharging belt 584 on which coins are conveyed is provided at a position where it overlaps with the sideling rotary disc 476 in the up-and-down direction, at a level lower than the flicking unit 480.

In other words, between an upper end and a lower end of the rotary disc 476, the disbursing money conveying device 128 is disposed. On both sides of the money discharging belt 584, guide plates 586 and 588 are disposed along its longitudinal direction, and a coin flicked out will be guided so as to drop on the money discharging belt 584 after colliding with the back face of the slide base 220. This arrangement makes it possible to decrease the dimension of the up-and-down direction. The disbursing money conveying device 128 is driven by the electric motor 590 fixed to the frame 350 via a belt 592.

Next, the distributing unit 582 will be explained with reference to FIGS. 16 and 17. The distributing unit 582 distributes coins conveyed by the disbursing money conveying device 128 into the money discharging port 110 or the cash box 112.

Figure 16:
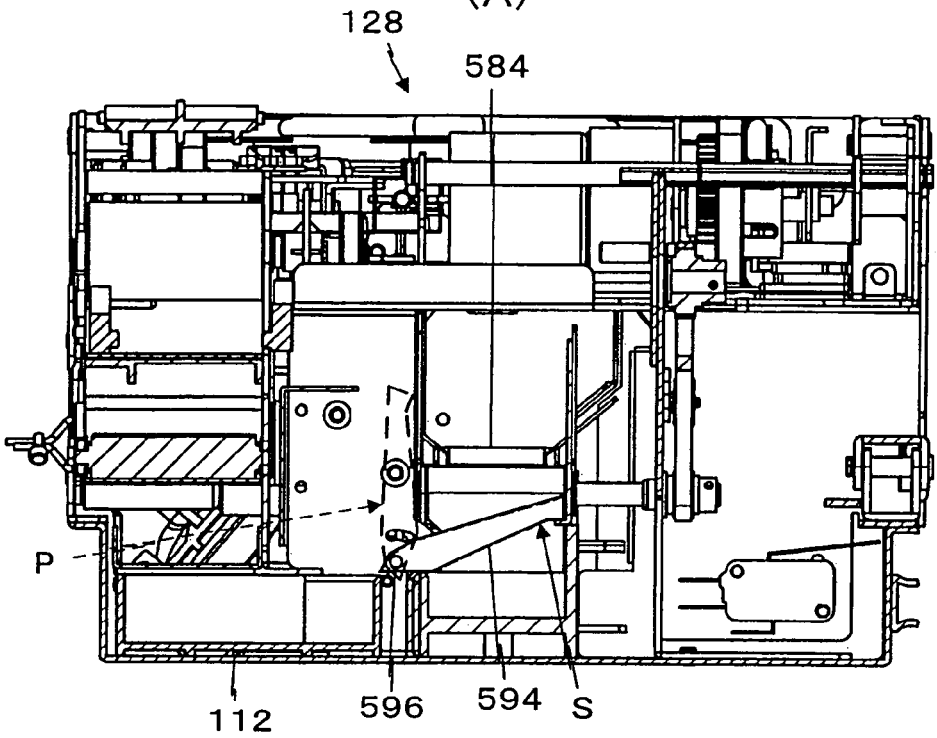
Figure 16:
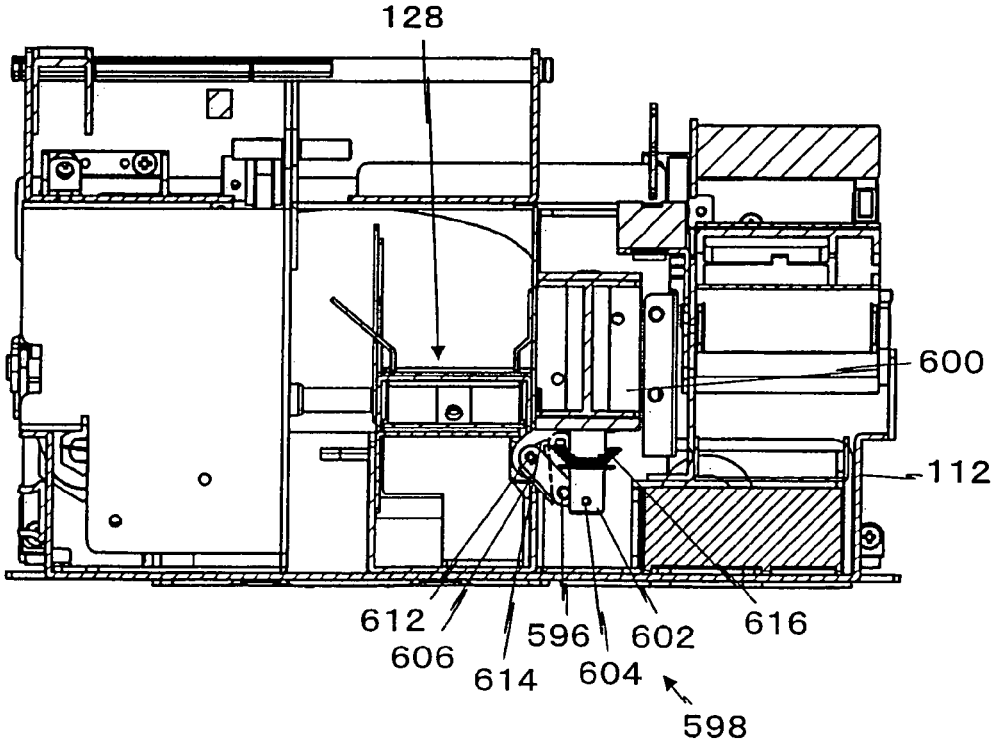
Figure 17:
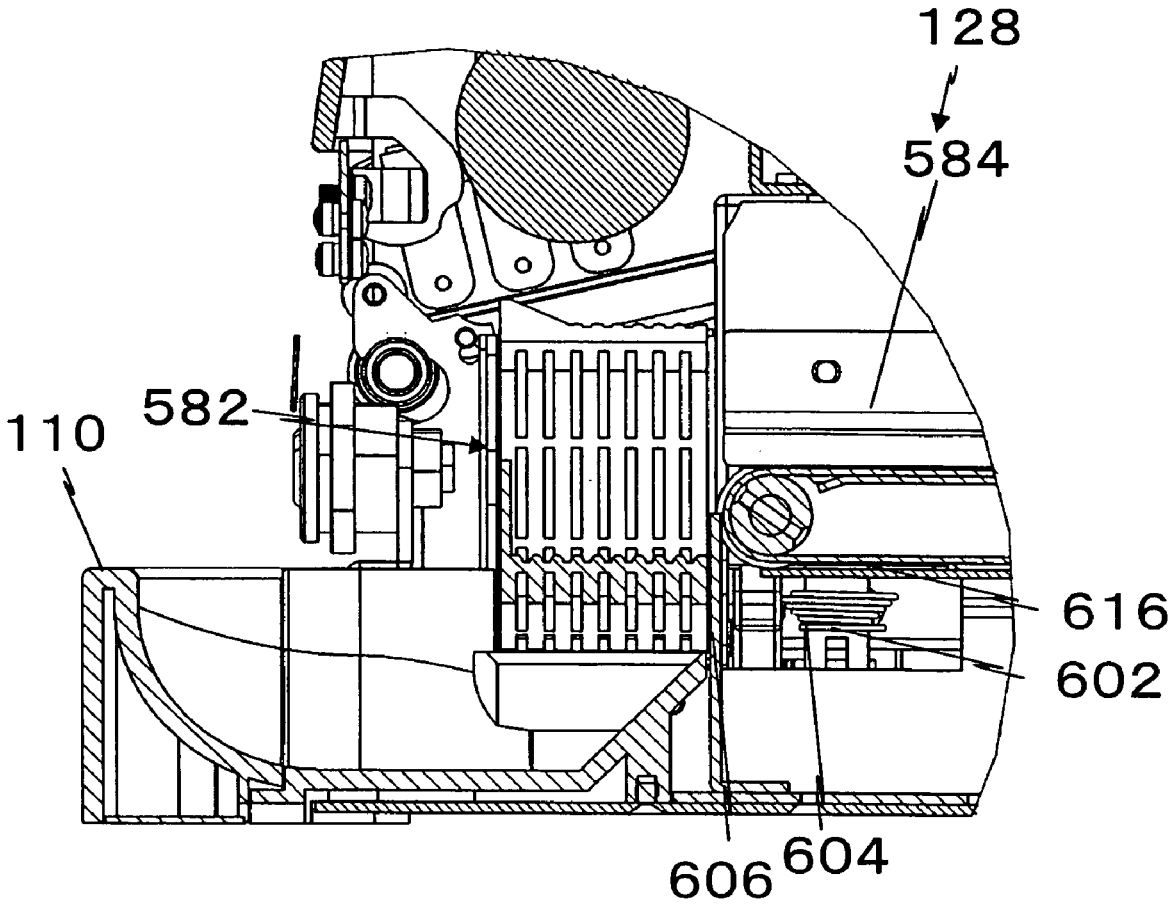
FIG. 17 is an enlarged cross section view of a money discharging port of a coin receiving and disbursing apparatus embodying the present invention.

As shown in FIG. 16, on the side of the money discharging port 110 in the disbursing money conveying device 128, a distributing plate 594 is fixed to an axis 596 existing below and beside the discharged money disbursing money conveying part 128. The distributing plate 594 is disposed right beside and below the conveyance belt 584, and in an upper part of an end part of the bowl-like money discharging port 110. This plate 594 is selectively shifted by a shifter 598 between a reserving position S below the belt 584 where the top face is inclined toward the cash box 112 and a money discharging position P standing on the lateral side of the disbursing money conveying device 128 shown by the dotted line.

Therefore, when the plate 594 is in the money discharging position P, the plate 594 is not located below the belt 584, and hence the coin conveyed by the disbursing money conveying device 128 directly drops into the bowl-like money discharging port 110. When the plate 594 is in the reserving position S, the coin dropped from the disbursing money conveying device 128 slides down the plate 594 after dropping on the plate 594, to be reserved in the cash box 112. Therefore, the distributing unit 582 may be replaced by other device having a similar function.

Next, the shifter 598 of the distributing unit 582 will be explained with reference to FIG. 16(B). In the shifter 598, a pin 604 fixed to a plunger 602 of a solenoid 600 fixed to the frame 122 is inserted through a slot (not shown) of the lever extending opposite to an axis 596 of the lever 606. The lever 606 is fixed to the axis 596, and fixed with a pin 612 at its end.

The pin 612 is movable in the arcuate slot 614 extending about an axis 608, and movement thereof is restricted by the both ends of the slot. Therefore, the plunger 602 is usually urged by a spring 616 so as to protrude. As a result, the pin 612 is stopped at one end of the slot 614, and the lever 606 is held at the position shown by the dotted line, with the result that the plate 594 is held at the money discharging position P. When the solenoid 600 is excited, the pin 612 is stopped at another end of the slot 614, and the plate 594 is held at the reserving position S.

As shown in FIGS. 3, 5, 8, 10, 13 and 15, it is preferred to detachably attach a single coin slot-in unit 622 to an upper end opening 620 of the money receiving port 104. In the single coin slot-in unit 622 according to the present embodiment, a restriction plate 626 formed with a slot-in plate through which only one coin may be inserted is pivotably attached to an axis 628 fixed to the back wall to which the breaking roller 158 is attached.

In a middle part of the restriction plate 626, a slot-in slit 624 is formed so as to extend laterally. The slot-in slit 624 is rectangular and has a diameter slightly larger than that of the two-euro coin having the largest diameter, and a thickness slightly larger than that of the 50-cent coin having the largest thickness. In other words, the slot-in slot 624 is formed such that the longitudinal direction thereof is perpendicular to the traveling direction of the band conveyer 134.

From the downstream lateral edge of the slot-in slit 624, an abutting plate 670 in a form of a flat plate extending upward is provided. By bringing one face of a coin into abutment with the abutting plate 670, the coin is readily inserted through the slot-in slit 624, and the restriction plate 626 is easy to pivot about the axis 628 by clipping the plate 670.

The restriction plate 626 may be detachably attached to the money receiving port 104 with a screw or the like, or may be formed integrally with the money receiving port 104. Further, the restriction plate 626 may be detachably attached to the money receiving port 104, or may allow selection between a single reception mode wherein coins are inserted through the slot-in slit 624 one by one and a collective reception mode wherein coins are collectively inserted through the money receiving port 104, as appropriate.

Next, the operation of the present embodiment will be explained. The reference character "C" means a coin. In the following embodiment, an example when a single coin slot-in unit 622 is not mounted to the money receiving port 104 will be illustrated. When a coin is inserted through the money receiving port 104, and placed on the belt 144 near the slot-in sensor 156, it is detected by the slot-in sensor 156. Upon detection by the slot-in sensor 156, the driving motor 150 is forwardly rotated, and the upper belt 144U of the belt 144 is moved right in FIG. 5.

In conjugation with this, the breaking roller 158 is rotated in the clockwise direction. Then the electric motor 452 rotates, and the eighth pulley 438 is rotated via the driving gear 460, the driven gear 462 and the driving axis 436, and the fourth belt 440 is circulated in the clockwise direction in FIG. 13. In a similar manner, the third belt 380 is circulated in the same direction via the seventh pulley 434 and the sixth pulley 376.

Further, the second belt 374 is circulated in the clockwise direction in FIG. 10 via the fifth pulley 373 and the fourth pulley 372. Further, the first belt 340 is circulated in the same direction via the third pulley 360 and the second pulley 358. Furthermore, the electric motor 590 rotates and drives so that the top face of the money discharging belt 584 of the disbursing money conveying device 128 moves left in FIG. 8 via the belt 592.

Since the solenoid 600 of the driving device 598 is usually degaussed, the plunger 602 is pulled down by the spring 616, the pin 612 is stopped by the right end edge of the arcuate slot 614 in FIG. 16B, and the distributing plate 594 is held at the money discharging position P. In other words, a coin conveyed by the disbursing money conveying device 128 is in a condition of being fed to the money discharging port 110.

Coins on the belt 144 are separated by the breaking roller 158 and aligned one by one while either face is in contact with the upper belt 144U, and passed through the gap 164 below the breaking roller 158. Then the bottom face of the first belt 340 and the top face of the coin come into contact with each other at the relay part 148, and after dragged in short time by the first belt 340 traveling slightly faster than the belt 144, the coin is transferred on the slide base 173.

The coin on the slide base 173 is moved in the conveyance direction D by the first belt 344, and guided by the first guide rail 174 after contacting with the deviation guide part 176. After being guided by the deviation guide part 176, the coin is guided by the judgment guide part 178. Since the first belt 340 inclines so as to form an acute angle with the judgment guide part 178 and the reject guide part 180, the coin is conveyed while being in contact with the judgment guide part 178.

In other words, since the first belt 340 is provided so that it becomes closer to the first guide rail 174 as it goes downstream, the coin is conveyed while receiving pushing power by the first guide 174. Therefore, the coin moves along the judgment guide 178 in the denomination judging device 125.

The denomination judging device 125 judges the material of the coin conveyed by the first belt 340 according to a signal from the material sensor 202 which is able to face with every size of coins, and judges the diameter of according to signals from the first diameter sensor 186, the second diameter sensor 196 and the third diameter sensor 190, and judges the thickness of the coin according to a signal from the first diameter sensor 186.

To be more specific, since a one-cent coin having the smallest diameter faces the core 184 of the first diameter sensor 186 by generally one third of its area, a signal corresponding to the opposing area is outputted from the first diameter sensor 186, while no signal is transmitted from the second diameter sensor 196 and the third diameter sensor 190. The judgment is achieved by comparing these signals with a reference value.

Since a two-euro coin having the largest diameter faces the entire surface of the cores 184U and 184L of the first diameter sensor 186 and the core 198U of the second diameter sensor 196, and faces approximately one third of the cores 194U, 194L of the third diameter sensor 190, comprehensive judgment is conducted by comparing signals from these sensor with reference values. At this time, since the cores 184U, 194L of the first diameter sensor 186 faces the entire face of the coin, they may be utilized for determining the thickness of the coin.

As to other coins from a two-cent coin to a 50-cent coin, the diameter and thickness are judged according to signals from the first diameter sensor 186, the second diameter sensor 196 and the third diameter sensor 190, and the denomination of each coin is identified. According to the identification result, the solenoid 210 is excited for a predetermined time in order to expel any fake or unacceptable coins. Upon excitation of the solenoid 210, the reject member 208 is moved below the first guide rail 174.

A coin having passed through the denomination judgment device 125 is delivered to the second belt 374 from the first belt 340, and reaches the reject coin sorter 128. Since the second belt 374 is also inclined so as to cross with the reject guide part 180 and the second guide rail 222 at an acute angle, the coin is conveyed along the leaving path 236 while the periphery is pushed against the reject guide part 180 and the second guide rail 222.

When a fake or unacceptable coin passes the reject coin sorter 128, the coin will drop into the reject path 214 from the dropping port 206 of the reject guide part because the reject member 208 lacks the point at which the lower part of the periphery of the coin is supported. Then the coin slides on the inclined bottom face of the reject path 214 and drops on the money discharging belt 584. The dropped coin is conveyed toward the money discharging port 110 by the money discharging belt 584, and allowed to drop through the money discharging port 110 for return.

When the denomination judging device 125 identifies an acceptable coin from one-cent coin to two-euro coin, the solenoid 210 is not excited. Accordingly, the reject member 208 is positioned on the center side of the judging and rejecting conveyance path 170 than the reject guide part 180. As a result, the coin passes through the reject coin sorter 128 while being supported at a lower side of the periphery by the reject member 208 and the slide base 173.

The coin passed through the reject coin sorter 128 travels the leaving path 236 while the periphery thereof is guided by the second guide rail 222. In this course, since a one-cent coin is not supported at the bottom face of the periphery on the side of the first support rail by the dropping edge 260 of the slide base 220, the one-cent coin drops into the sorting hole 252. The dropped one-cent coin is reserved in a reservation bowl 478 of the one-cent hopper 562. Other denominations of coins having larger diameter than the one-cent coin will reach the two-cent sorting hole 254 provided downstream while supported by the edge 260 at its bottom face.

Similarly to the above, a two-cent coin drops into the two-cent sorting hole 254 and then reserved in the two-cent hopper 564. Directly after passing through the two-cent sorting part 248, the coin is delivered to the third belt 380. Then as is the same with the above, a 10-cent coin drops into the 10-cent sorting hole 256 and reserved in the 10-cent hopper 566.

The coin that is not sorted in the first sorting part 244 is conveyed along the U-turn path 238 by friction contact with the third belt 380 while guided by the U-turn guide rail 224.

The U-turn path 238 is arcuate, and as shown in FIG. 11, the third belt 380 guided by the first guide roller 381 faces with the arcuate segment 322, the third belt 380 guided by the second guide roller 382 faces with the arcuate segment 324, the third belt 380 guided by the third guide roller 384 faces with the arcuate segment 332, the third belt 380 guided by the fourth guide roller 386 faces with the arcuate segment 334, the third belt 380 guided by the fifth guide roller 388 faces with the arcuate segment of the outlet part 312, and the belt 380 in a linear condition between each guide roller faces with each of the linear segments 316, 318, 326, 328 and 330.

In this manner, the coin moves smoothly while guided by the U-turn guide rail 224. Furthermore, a distance between the slide base 200 and each guide roller is changed depending on the position of the detection roller 420.

For example, when a 50-cent coin which is the thickest coin among the coins passing through the U-turn path 238 passes the third guide roller 384 following the five-cent coin which is the thinnest coin, the detection roller 420 is pushed up by the third belt 380 that is pushed up by the 50-cent coin.

As a result, the support lever 396 is pivoted about the stationary axis 394 via the roller stay 424 and the first stay 412, as a result, the guide roller 384 is moved upward and then the 50-cent coins reaches the third guide roller 384. In this manner, the thick 50-cent coin can smoothly pass without coming into collision with the guide roller 384.

Directly before reaching the five-cent sorting part 272, the coin is delivered to the fourth belt 440 from the third belt 380. Since the fourth belt 440 is inclined so as to cross with the third guide rail 226 at an acute angle, the coin conveyed by friction contact with the fourth belt 440 is conveyed while the periphery thereof is pushed against the third guide rail 226.

Since the outlet part 312 and the third guide rail 226 forms a blunt angle, the coin reaches the third guide rail 226 after being pushed against the outlet part 312 of the U-turn guide rail 224. Therefore, the coin is guided along the third guide rail 226 by the fourth belt 440.

A five-cent coins drops into the five-cent sorting hole 282 in the same manner as described above, and then is reserved or stored in the five-cent hopper 570. Then a 20-cent coin drops into the 20-cent sorting hole 284 and is reserved in the 20-cent hopper 572. Next, a one-euro coin drops into the one-euro sorting hole 286 and is reserved in the one-euro hopper 574. Next, a 50-cent coin drops into the 50-cent sorting hole 288 and is reserved in the 50-cent hopper 576. Finally, a two-euro coin drops into the two-euro sorting hole 290, and is reserved into the 2-euro hopper 578.

When the slot-in sensor 156, sensors 166A, 166B, 166C and the denomination judging device 125 have not detected a coin for a predetermined period of time, it is determined that all of the coins inserted through the money receiving port 104 have been sorted, and then the motors 150, 452 and 590 are stopped after a lapse of a predetermined period of time from the last signal. This completes the money receiving process.

Next, a money disbursing process will be explained. For example, when coins are propelled or flicked out one from each hopper, first, the motor 590 rotates, to circulate the money discharging belt 584 in the counterclockwise direction in FIG. 8. Next, the 10-cent hopper 566, the five-cent hopper 570, the two-cent hopper 564, the 20-cent hopper 572, the one-cent hopper 562, the one-euro hopper 574, the 50-cent hopper 576 and the two-euro hopper 578 are started in this order with a slight time difference from the money discharging port 110.

In the 10-cent hopper 566, the motor 484 rotates, and the rotary disc 476 is rotated in the counterclockwise direction in FIG. 14 via the decelerating mechanism 488. By this rotation, the coin having dropped into the through hole 491 is guided in the circumferential direction of the rotary disc 476 by the pins 500 and 502, and flicked out by the flicking unit 480. Since the coin is guided by the base 474 at this time, it is flicked out upward or diagonally upward of the money discharging belt 584 according to the slope of the base 474.

Therefore, the coin is flicked out diagonal upwardly against gravity, and the momentum of the propelled coin is attenuated. Furthermore, since the coin comes into a collision contact with the back face of the slide base 220 and the guiding walls 586 and 588 on each side, the momentum is also further attenuated by this event before dropping onto the money discharging belt 584 which can be an endless conveyer belt. Therefore, the coin whose momentum of propulsion is attenuated will relatively come into a gentle surface contact with the money discharging belt 584, and will be easily conveyed to the money discharging port 110.

Since the flicked out coin is detected by the coin sensor 482, the 10-cent hopper 566 automatically stops the motor 484 by self control, and stops flicking out coins. Similarly, each of the hopper 570, 564, 572, 562, 574, 576 and 578 flicks out one coin in this order. After a lapse of a time period that is sufficient to allow the conveyance of a coin to the money discharging port 110 from stopping of the last two-euro hopper 280, the driving motor 590 is stopped and the money disbursing process ends.

Each of the hoppers 570, 564, 572, 562, 574, 576 and 578 may be started in an appropriate manner, for example, from the money discharging port 110. When coins are to be reserved in the cash box 112 from a filled hopper, the solenoid 600 is excited, and the distributing plate 594 is held in a reserving position S. As a result, a coin conveyed by the money discharging belt 584 drops on the distributing plate 594, slides thereon, and drops into the cash box 112 where it is stored.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin receiving and disbursing apparatus comprising:

an alignment device that aligns coins inserted through a coin receiving port;

a received money conveying device that causes the aligned coins to travel along a received money conveying path;

a sorting part sorting the coins conveyed by the received money conveying device by denomination;

a plurality of hoppers arranged in a first hopper array and a second hopper array for reserving the coins sorted by the sorting part by denomination in bulk condition, each of the plurality of hoppers including a rotary disc and a releasing unit that is spring biased to propel coins in a trajectory upward and away from the rotary disc;

a disbursing money conveying device disposed between the first hopper array and the second hopper array, the first hopper array and the second hopper array arranged symmetrically at predetermined intervals along the disbursing money conveying device;

a base member positioned above the disbursing money conveying device within the trajectory of the propelled coins from the releasing unit wherein each rotary disc having an upper end and a lower end positioned so that its lower end is laterally farther from the disbursing money conveying device than its upper end, and wherein the releasing unit flicks out a coin upward towards both the disbursing money conveying device and the base member, and the coin contacts the base member to be guidingly dropped on the disbursing money conveying device; and a money discharging port for releasing the flicked coins conveyed by the disbursing money conveying device, the disbursing money conveying device disposed between the upper end and the lower end of the rotary discs and positioned parallel with the first and second hopper arrays.

2. The coin receiving and disbursing apparatus according to claim 1, wherein each of the plurality of hoppers includes a through hole that allows coins to drop one by one.

3. The coin receiving and disbursing apparatus according to claim 1, wherein a part of each of the plurality of hoppers overlaps with a part of the disbursing money conveying device in the vertical direction.

4. The coin receiving and disbursing apparatus according to claim 1, wherein the coin receiving port and the money discharging port are arranged substantially parallel with each other;

the received money conveying path has a channel form and coins are aligned in a horizontal line by the alignment device after passing through the coin receiving port to travel a path from the coin receiving port through a U-turn and then travel a path approaching the money discharging port;

at least one specific sorting part is provided along each of the leaving path and the approaching path;

the plurality of hoppers are arranged in parallel below the sorting parts, and between the alignment device and the sorting part of the leaving path a denomination judging device and a reject coin sorting device are arranged wherein the reject coin sorting device returns fake coins to the disbursing money conveying device.

5. The coin receiving and disbursing apparatus according to claim 1, wherein disbursing money conveyance device has a belt arranged to slope downward towards the money discharging port.

6. A compact coin sorting and disbursement apparatus comprising;

a first coin conveying device to transport coins of different denominations;

a plurality of sorter units operatively positioned to remove coins of a specific denomination from the first coin conveying device;

a plurality of storage hoppers operatively positioned to receive from the plurality of sorter units coins of a specific denomination;

a rotating disc mounted on each of the plurality of storage hoppers and having an upper and a lower portion;

a coin propelling member mounted on each of the plurality of storage hoppers to propel a coin from a respective storage hopper outward and upward relative to each of the plurality of storage hoppers;

a second coin conveying device "that is disposed at a height between the heights of the upper and lower portions of said disc" positioned between the plurality of storage hoppers to receive the respective coins propelled upward from the plurality of hoppers wherein the propelled coins have a trajectory that rises above the second coin conveying device before dropping onto the second coin conveying device; and a base member positioned above the second coin conveying device within a trajectory path of the coins propelled by the coin propelling member to contact and guidingly drop the coins onto the second coin conveying device.

7. The compact coin sorting and disbursement apparatus of claim 6 wherein the coin propelling member includes a spring based lever for striking the coin to propel the coin.

8. The compact coin sorting and disbursement apparatus of claim 7 wherein the second coin conveying device is an endless discharging conveyer belt.

* * * * *